US009391389B2

(12) United States Patent
Ohmori et al.

(10) Patent No.: US 9,391,389 B2
(45) Date of Patent: Jul. 12, 2016

(54) TERMINAL CONNECTION STRUCTURE FOR ELECTRIC WIRE

(71) Applicant: Yazaki Corporation, Tokyo (JP)

(72) Inventors: Yoshitake Ohmori, Kakegawa (JP); Hajime Kato, Kakegawa (JP); Kazuhiro Tomine, Kakegawa (JP); Takaaki Miyajima, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/826,687

(22) Filed: Aug. 14, 2015

(65) Prior Publication Data

US 2015/0357748 A1 Dec. 10, 2015

Related U.S. Application Data

(63) Continuation of application No. PCT/JP2014/053550, filed on Feb. 14, 2014.

(30) Foreign Application Priority Data

Feb. 15, 2013 (JP) ..... 2013-027789
Apr. 26, 2013 (JP) ..... 2013-094675

(51) Int. Cl.
*H01R 12/00* (2006.01)
*H01R 13/52* (2006.01)
(Continued)

(52) U.S. Cl.
CPC ..... *H01R 13/5202* (2013.01); *H01R 9/0512* (2013.01); *H01R 9/0527* (2013.01); *H01R 13/6596* (2013.01); *H01R 24/52* (2013.01); *H01R 4/023* (2013.01); *H01R 2103/00* (2013.01)

(58) Field of Classification Search
CPC ..... H01R 24/46; H01R 24/50
USPC ..... 439/63, 578, 582
See application file for complete search history.

(56) References Cited

U.S. PATENT DOCUMENTS 5,662,480 A * 9/1997 Togashi ..... H01R 24/50 439/582
7,025,598 B2 * 4/2006 Ikeda ..... H01R 24/50 439/582

(Continued)

FOREIGN PATENT DOCUMENTS

JP 59-49381 U 4/1984
JP 2008-60035 A 3/2008

(Continued)

OTHER PUBLICATIONS

Written Opinion dated May 20, 2014 issued by International Searching Authority in counterpart International Application No. PCT/JP2014/053550.

(Continued)

*Primary Examiner* — Phuong Dinh
(74) *Attorney, Agent, or Firm* — Sughrue Mion, PLLC

(57) ABSTRACT

A terminal connection structure for an electric wire includes a first terminal having a first extension section extended from a first connection section in a nearly semi-cylindrical shape and connected to the first terminal member of a mating connection device to be connected to the electric wire and a second terminal having a second extension section extended from a second connection section in a nearly semi-cylindrical shape and connected to the second terminal member of the mating connection device to be connected to the electric wire, the first extension section and the second extension section being disposed coaxially so as to be opposed to each other and to form a nearly cylindrical shape.

5 Claims, 11 Drawing Sheets

(51) Int. Cl.

| | |
|---|---|
| ***H01R 9/05*** | (2006.01) |
| ***H01R 24/52*** | (2011.01) |
| ***H01R 13/6596*** | (2011.01) |
| *H01R 103/00* | (2006.01) |
| *H01R 4/02* | (2006.01) |

(56) References Cited

U.S. PATENT DOCUMENTS

| | | | | |
|---|---|---|---|---|
| 7,641,480 | B1 * | 1/2010 | Hossack | A61B 8/12 439/335 |
| 8,100,715 | B2 * | 1/2012 | Whitlock | H01R 24/38 439/580 |
| 2009/0011661 | A1 | 1/2009 | Imai | |
| 2010/0022126 | A1 | 1/2010 | Miyashita et al. | |
| 2012/0225570 | A1 | 9/2012 | Kanda | |
| 2013/0115787 | A1 | 5/2013 | Kanda | |
| 2015/0357748 | A1 * | 12/2015 | Ohmori | H01R 24/52 439/578 |

FOREIGN PATENT DOCUMENTS

| | | | |
|---|---|---|---|
| JP | 2009-16126 | A | 1/2009 |
| JP | 2011-100659 | A | 5/2011 |
| JP | 2011-100660 | A | 5/2011 |
| JP | 2012-22929 | A | 2/2012 |

OTHER PUBLICATIONS

Search Report dated May 20, 2014 issued in International Application No. PCT/JP2014/053550 (PCT/ISA/210), English Translation.

* cited by examiner

TERMINAL CONNECTION STRUCTURE FOR ELECTRIC WIRE

CROSS REFERENCE TO RELATED APPLICATION

This application is a continuation of PCT application No. PCT/JP2014/053550, which was filed on Feb. 14, 2014 based on Japanese Patent Application (No. 2013-027789) filed on Feb. 15, 2013 and Japanese Patent Application (No. 2013-094675) filed on Apr. 26, 2013, the contents of which are incorporated herein by reference.

BACKGROUND

1. Technical Field

The present invention relates to a terminal connection structure for an electric wire.

2. Description of the Related Art

Coaxial electric wires have conventionally been used widely as electric wires for use in wiring at portions (for example, in electric components mounted on automobiles) where electromagnetic waves and the like are required to be shielded (refer to JP-A-2009-16126). A coaxial electric wire has a configuration in which one or more internal conductors (core wires) are covered with a first insulating cover (internal insulator) and an external conductor provided on the outer circumference of the internal insulator is covered with a second insulating cover (external insulator). In addition, another configuration is also known in which a shield conductor is provided on the outer circumference of an external insulator and the shield conductor is covered with a third insulating cover (protection sheath). The terminal sections of these conductors are respectively connected to the connection terminals on the side of the coaxial electric wire, and the conductors are also connected to the connection terminals, circuits, electric wires, etc. of a mating connection device via the connection terminals, whereby the coaxial electric wire is electrically connected to the mating connection device.

In the case that the connection terminals on the side of the coaxial electric wire are connected to the plurality of conductors of the coaxial electric wire and the coaxial electric wire is connected via the connection terminals to, for example, the connection terminals of the mating connection device, a plurality of connection terminals are disposed at the terminal connection portion of the coaxial electric wire. In this case, for example, in the case that two internal conductors are drawn out in parallel and connected to the connection terminals on the side of the coaxial electric wire so as to face, for example, the connection terminals of the mating connection device, two connection terminals are disposed in parallel at the terminal connection portion on the side of the coaxial electric wire. Hence, the size of the terminal connection portion on the side of the coaxial electric wire becomes large, and this causes a problem in saving the space of the connection structure of the coaxial electric wire. Furthermore, since the connection terminals are disposed in parallel, the terminal connection portion on the side of the coaxial electric wire has a flat shape; hence, in the case that a waterproofing member, such as a rubber plug, is mounted, it is necessary to secure the waterproofness of the rubber plug by separately providing a structure for stopping the rotation of the rubber plug. In addition, as in the case of the terminal connection portion on the side of the coaxial electric wire, the terminal connection portion on the side of the mating connection device also becomes large in size; hence, for the purpose of saving the space of the connection structure of the coaxial electric wire having the above-mentioned configuration, it is necessary to consider the terminal connection structure on the side of the mating connection device.

SUMMARY

The present invention has been made in consideration of the above-mentioned circumstances, and an object of the present invention is to provide a terminal connection structure for an electric wire in which the size of the terminal connection portion of the electric wire (coaxial electric wire) can be made compact.

The above-mentioned object of the present invention is achieved by the configurations described in the following items (1) to (5).

(1) A terminal connection structure for an electric wire, in which terminals are connected to an internal conductor and an external conductor respectively in the electric wire, the electric wire comprising the internal conductor which is covered with a first insulating cover and the external conductor which is provided coaxially with the internal conductor to surround an outer circumference of the first insulating cover and covered with a second insulating cover, the terminal connection structure including: a first terminal comprising a first connection section which is connected to a part where the first insulating cover has been peeled so that the internal conductor is exposed and a first extension section which is extended from the first connection section in a nearly semi-cylindrical shape and is connected to a first terminal member of a mating connection device to be connected to the electric wire; and a second terminal comprising a second connection section which is connected to a part where the second insulating cover has been peeled off so that the external conductor is exposed and a second extension section which is extended from the second connection section in a nearly semi-cylindrical shape and is connected to a second terminal member of the mating connection device to be connected to the electric wire, wherein the first extension section of the first terminal and the second extension section of the second terminal are disposed coaxially so as to be opposed to each other and to form a nearly cylindrical shape.

With the configuration described in the above-mentioned item (1), the first terminal and the second terminal are disposed coaxially so as to be separated from each other. In addition, the first extension section and the second extension section are formed into a nearly semi-cylindrical shape, and the first terminal and the second terminal are disposed so that the extension sections are placed face-to-face with each other so as to be form a nearly cylindrical shape, whereby the configurations of the first terminal and the second terminal are simplified and processing cost can be reduced.

(2) The terminal connection structure for an electric wire configured as described in the above-mentioned item (1), further including a first spring section having a nearly semi-cylindrical shape and contacting with the first extension section and the first terminal member so that the first extension section is electrically connected to the first terminal member, and a second spring section having a nearly semi-cylindrical shape and contacting with the second extension section and the second terminal member so that the second extension section is electrically connected to the second terminal member, wherein the first spring section and the second spring section are disposed coaxially so as to be opposed to each other and to form a nearly cylindrical shape.

(3) The terminal connection structure for an electric wire configured as described in the above-mentioned item (1) or (2), further including an insulation section disposed between the first terminal and the second terminal, and a housing member that surrounds the outer circumference of the first terminal and the outer circumference of the second terminal, and the first terminal and the second terminal being received coaxially so as to be separated from each other.

(4) The terminal connection structure for an electric wire configured as described in any one of the above-mentioned items (1) to (3), wherein the first terminal and the second terminal are disposed coaxially in a bent direction bent from an extension direction of the electric wire.

(5) The terminal connection structure for an electric wire configured as described in the above-mentioned item (4), further including a sealing member that seals the first terminal and the second terminal from the outside, wherein the sealing member includes a bottom section and a lid section which are configured to be separated in the bent direction, and the bottom section and the lid section are assembled and integrated.

With the configurations described in the above-mentioned items (1) to (5), the size of the terminal connection portion of the electric wire (coaxial electric wire) can be made compact.

BRIEF DESCRIPTION OF THE DRAWINGS

FIG. 1A is a perspective view showing the terminal connection structure with the components thereof disassembled, and FIG. 1B is an overall perspective view showing the terminal connection structure with the components thereof shown in FIG. 1A assembled;

FIG. 5A is a perspective view showing the entire configuration, FIG. 5B is a perspective view showing configurations of connection terminals (first terminal member and second terminal member) to be connected to the first terminal (internal conductor terminal) and the second terminal (external conductor terminal), and FIG. 5C is a perspective view showing a configuration of a housing member in which the connection terminals are received;

FIG. 8A is a perspective view showing a state in which the components shown in FIG. 7 are assembled, viewed from the terminal side, and FIG. 8B is a perspective view showing the state in which the components are assembled, viewed from the side opposite to that shown in FIG. 8A;

FIG. 12A is a perspective view showing a state in which the components shown in FIG. 11 are assembled, viewed from the terminal side, and FIG. 12B is a perspective view showing the state in which the components shown in FIG. 11 are assembled, viewed from the side opposite to that shown in FIG. 12A.

DETAILED DESCRIPTION OF THE EXEMPLARY EMBODIMENTS

A terminal connection structure for an electric wire (hereafter simply referred to as a connection structure) according to the present invention will be described below referring to the accompanying drawings. The present invention relates to the connection structure of terminals being respectively connected to an internal conductor and an external conductor in an electric wire equipped with the internal conductor covered with a first insulating cover and the external conductor covered with a second insulating cover and provided coaxially with the internal conductor so as to surround the outer circumference of the first insulating cover. As the electric wire according to the present invention, it is possible to assume, for example, coaxial electric wires for use in the wiring at portions (for example, in electric components mounted on automobiles) where electromagnetic waves and the like are required to be shielded. However, the usage of the electric wire according to the present invention is not limited to that described above.

First Embodiment

Figure 1A:
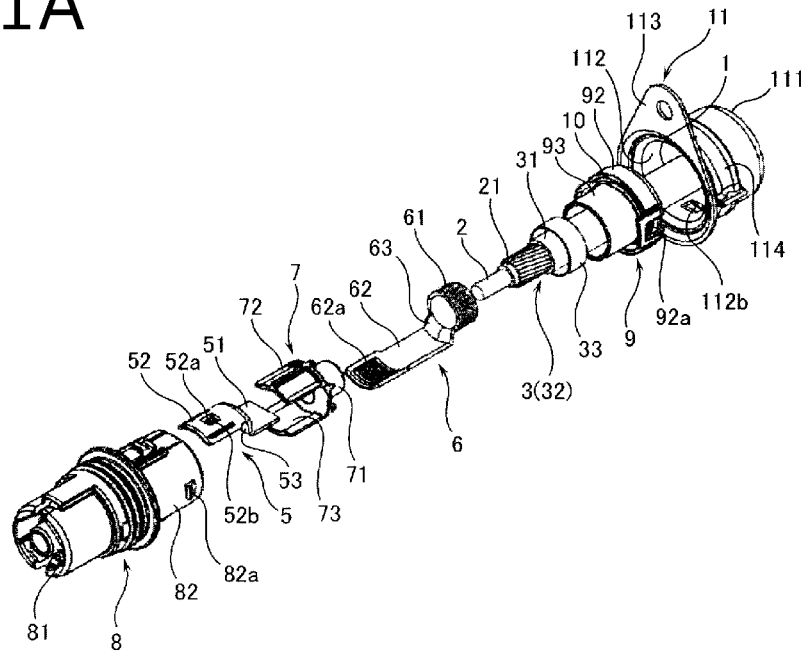
FIGS. 1A and 1B are views showing the whole of a terminal connection structure for an electric wire according to a first embodiment of the present invention.
Figure 1B:
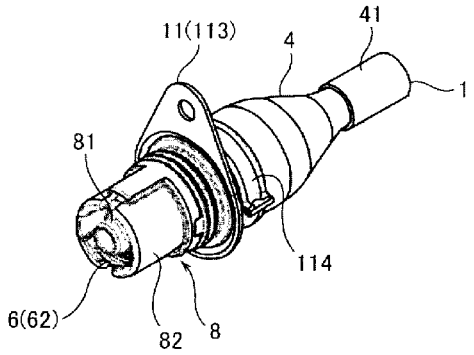
Figure 2:
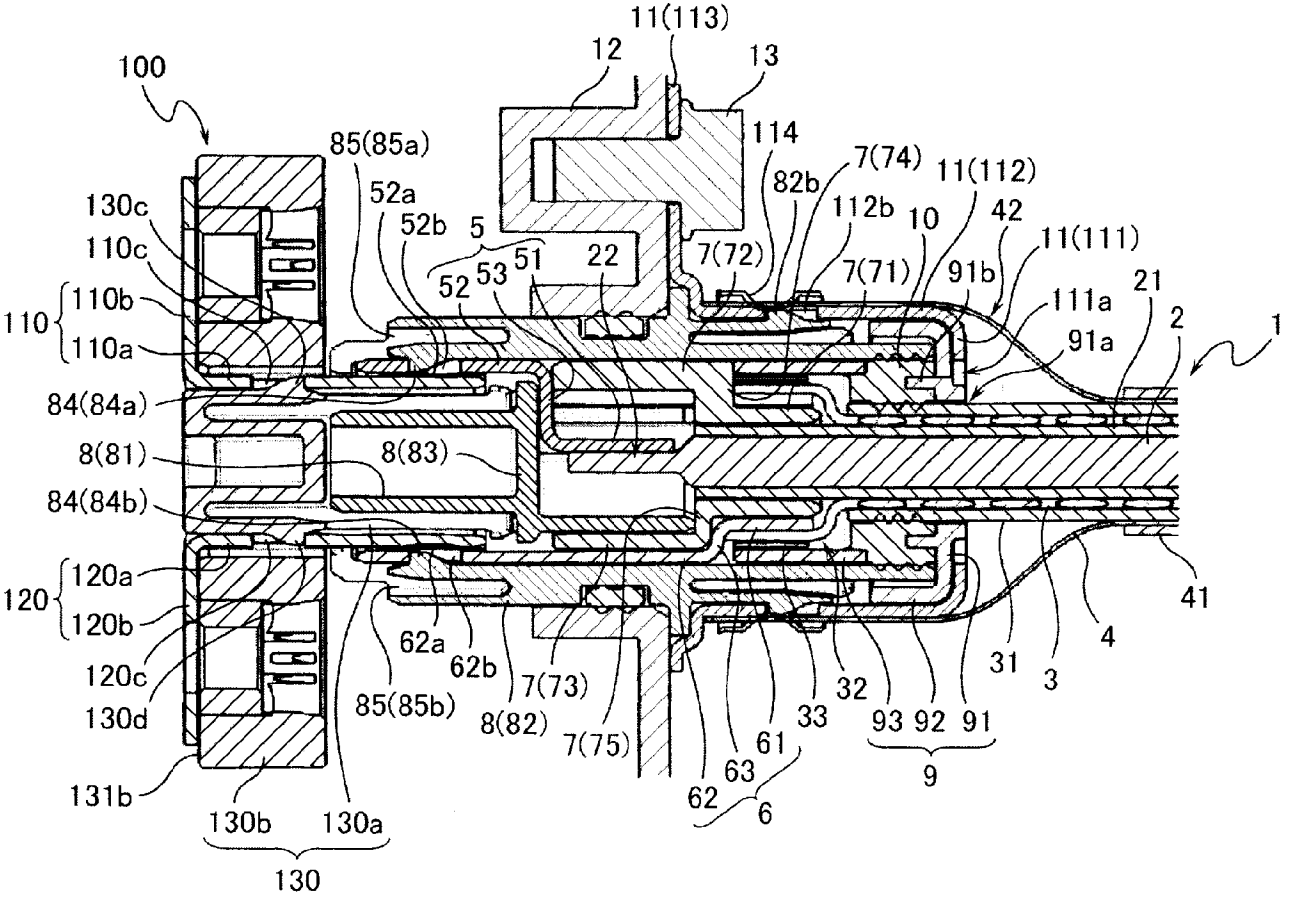
FIG. 2 is an entire cross-sectional view showing the terminal connection structure for the electric wire according to the first embodiment of the present invention.

FIGS. 1 and 2 show a connection structure according to a first embodiment of the present invention. FIGS. 1A and 1B are perspective views showing the whole of the connection structure; FIG. 1A is a perspective view showing the connection structure with the components thereof disassembled, and FIG. 1B is an overall perspective view showing the connection structure with the components thereof shown in FIG. 1A assembled. FIG. 2 is a cross-sectional view showing the whole of the connection structure.

As shown in FIGS. 1A to 2A, an electric wire according to the first embodiment is equipped with an internal conductor 2 covered with a first insulating cover (hereafter referred to as an internal insulator) 21 and an external conductor 3 covered with a second insulating cover (hereafter referred to as an external insulator) 31 and provided coaxially with the internal conductor 2 so as to surround the outer circumference of the internal insulator 21. Furthermore, the electric wire 1 is equipped with a shield conductor 4 covered with a third insulating cover (hereafter referred to as a protection sheath) 41 and provided coaxially with the internal conductor 2 and the external conductor 3 so as to surround the outer circumference of the external insulator 31. In this case, the internal conductor 2, the external conductor 3 and the shield conductor 4 can have any given forms; for example, it can be assumed that the internal conductor 2 and the external conductor 3 are each a stranded wire and that the shield conductor 4 is a braided wire or foil. Moreover, the internal insulator 21, the external insulator 31 and the protection sheath 41 are formed of an insulating material (for example, a resin, such as polyethylene, vinyl chloride or silicone). In other words, the electric wire 1 is configured as the so-called coaxial electric wire (three-layer coaxial electric wire) suitable for use in portions where, for example, electromagnetic waves are required to be shielded. In this first embodiment, as an example, it is assumed that the electric wire 1 is configured as a two-pole electric wire 1 equipped with the internal conductor 2 having a positive potential (positive pole) and the external conductor 3 having a negative potential (negative pole) or equipped with the internal conductor 2 having a negative potential (negative pole) and the external conductor 3 having a positive potential (positive pole) and that the electric wire 1 is used for a direct current circuit. However, it can also be assumed that the electric wire is equipped with a plurality of internal conductors and configured as a three-pole electric wire to be used for a three-phase alternate current circuit or a single-phase three-wire circuit, for example.

The connection structure according to the first embodiment is equipped with a first terminal (hereafter referred to as an internal conductor terminal) 5 and a second terminal (hereafter referred to as an external conductor terminal) 6. In addition, the connection structure according to the first embodiment is equipped with an insulation section (hereafter referred to as an inner holder) 7 disposed between the internal conductor terminal 5 and the external conductor terminal 6 and a housing member (hereafter referred to as a terminal housing) 8 by which the outer circumference of the internal conductor terminal 5 is surrounded and the outer circumference of the external conductor terminal 6 is surrounded and in which the internal conductor terminal 5 and the external conductor terminal 6 are received coaxially so as to be separated from each other. In the following descriptions, with respect to the extension direction (the left-right direction in FIG. 2) of the electric wire 1, the side (the left side in FIG. 2) to which the internal conductor terminal 5 and the external conductor terminal 6 are connected is referred to as a terminal side, and the opposite side (the right side in FIG. 2) is referred to as a base end side.

Figure 3:
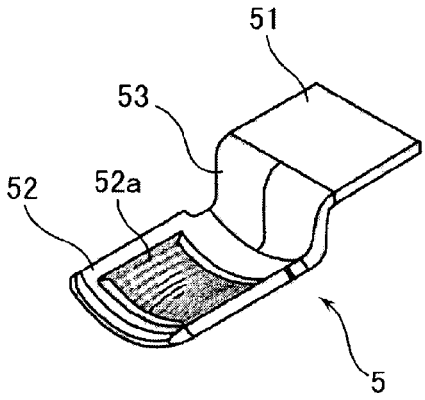
FIG. 3 is a perspective view showing a configuration of a first terminal (internal conductor terminal) according to the first embodiment of the present invention.

FIG. 3 is a perspective view showing a configuration of the internal conductor terminal 5. The internal conductor terminal 5 has a first connection section (hereafter referred to as an internal terminal connection section) 51 that is connected to the portion from which the internal insulator 21 is peeled off so that the internal conductor 2 is exposed and a first extension section (hereafter referred to as an internal terminal extension section) 52 that is extended from the internal terminal connection section 51 in a nearly semi-cylindrical shape and connected to the first terminal member (the terminal block internal terminal 110 of a terminal block 100 to be described later) of a mating connection device (for example, an electric component mounted on an automobile) to be connected to the electric wire 1.

The internal terminal connection section 51 is formed into a flat plate shape extending along the terminal section 22 of the internal conductor 2 from which the internal insulator 21 is peeled off. In this case, the internal terminal connection section 51 has a flat plate shape having a flat face formed along the contact face of the terminal section 22 and the flat face is made contact with the contact face of the terminal section 22, whereby the internal terminal connection section 51 is connected to the internal conductor 2. The internal terminal connection section 51 may merely be configured so as to have a form corresponding to the form of the terminal section 22. For example, in the case that the contact face of the terminal section 22 is a convex curved face, the internal terminal connection section 51 may merely be formed into a semi-cylindrical shape having a concave curved face formed along the convex curved face.

The internal terminal extension section 52 is extended from the internal terminal connection section 51 via an internal terminal continuation section 53 provided so as to continue to one end (the end section on the terminal side) of the internal terminal connection section 51 while being bent approximately at right angles. In this case, the internal terminal extension section 52 is equipped with a first spring section 52*a* that is made contact with the first terminal member (the terminal block internal terminal 110) so that the internal terminal extension section 52 can be electrically connected to the terminal block internal terminal 110. The first spring section 52*a* is a member that generates a predetermined elastic force (pushing force) when bent and deformed elastically, thereby maintaining the contact state between the first spring section 52*a* and the terminal block internal terminal 110 by using the pushing force so that electrical connection can be established therebetween. The first spring section 52*a* may merely be configured, for example, such that a plurality of slits are formed in the axial direction of the cylindrical shape of the internal terminal extension section 52 so as to provide spring pieces between the slits and the spring pieces are curved into a curved concave shape in a diameter shrinking direction so that the spring pieces can be bent and deformed elastically. Hence, the first spring section 52*a* is configured such that the spring pieces protrude toward the inner diameter side of the internal terminal extension section 52. The first spring section may be configured so as to be provided on the first terminal member (the terminal block internal terminal 110) instead of the internal terminal extension section 52, provided that the first spring section is configured so as to make contact with the internal terminal extension section 52 and the terminal block internal terminal 110 so that electrical connection can be established between the internal terminal extension section 52 and the terminal block internal terminal 110. Furthermore, although the internal terminal extension section 52 is configured so as to be integrally provided with the first spring section 52*a* in the first embodiment, the first spring section may be configured so as to be integrated with the terminal block internal terminal 110 or may be configured (as a separate member) so as to be separated from the internal terminal extension section 52 and the terminal block internal terminal 110.

Figure 4:
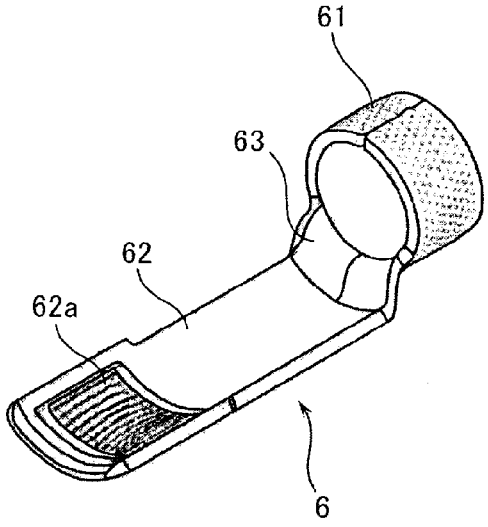
FIG. 4 is a perspective view showing a configuration of a second terminal (external conductor terminal) according to the first embodiment of the present invention.

FIG. 4 is a perspective view showing a configuration of the external conductor terminal 6. The external conductor terminal 6 has a second connection section (hereafter referred to as an external terminal connection section) 61 that is connected to the portion from which the external insulator 31 is peeled off so that the external conductor 3 is exposed and a second extension section (hereafter referred to as an external terminal extension section) 62 that is extended from the external terminal connection section 61 in a nearly semi-cylindrical shape and connected to the second terminal member (the terminal block external terminal 120 of the terminal block 100 to be described later) of a mating connection device (for example, an electric component mounted on an automobile) to be connected to the electric wire 1.

The external terminal connection section 61 is formed into a nearly cylindrical shape having an inside diameter larger than the outside diameter of the inner holder connection section 71 of the inner holder 7 to be described later and is used to cover the electric wire 1. Furthermore, the external terminal connection section 61 makes contact with the terminal section 32 of the external conductor 3 while being held between the terminal section 32 of the external conductor 3 from which the external insulator 31 is peeled off and the inner holder connection section 71 of the inner holder 7 to be described later, thereby being connected to the external conductor 3.

The external terminal extension section 62 is extended from the external terminal connection section 61 via an external terminal continuation section 63 provided so as to continue to one end (the end section on the terminal side) of the external terminal connection section 61 while being bent approximately at right angles. In this case, the external terminal extension section 62 is equipped with a second spring section 62*a* that is made contact with the second terminal member (the terminal block external terminal 120) so that the external terminal extension section can be electrically connected to the terminal block external terminal 120. The second spring section 62*a* is a member that generates a predetermined elastic force (pushing force) when bent and deformed elastically, thereby maintaining the contact state between the second spring section 62*a* and the terminal block external terminal 120 by using the pushing force so that electrical connection can be established therebetween. The second spring section 62*a* may merely be configured, for example, such that a plurality of slits are formed in the axial direction of the cylindrical shape of the external terminal extension section 62 so as to provide spring pieces between the slits and the spring pieces are curved into a concave curved shape in a diameter shrinking direction so that the spring pieces can be bent and deformed elastically. Hence, the second spring section 62*a* is configured such that the spring pieces protrude toward the inner diameter side of the external terminal extension section 62. The second spring section may be configured so as to be provided on the terminal block external terminal 120 instead of the external terminal extension section 62, provided that the second spring section is configured so as to make contact with the external terminal extension section 62 and the terminal block external terminal 120 so that electrical connection is established between the external terminal extension section 62 and the terminal block external terminal 120. Furthermore, although the external terminal extension section 62 is configured so as to be integrally provided with the second spring section 62*a* in the first embodiment, the second spring section may be configured so as to be integrated with the terminal block external terminal 120 or may be configured (as a separate member) so as to be separated from the external terminal extension section 62 and the terminal block external terminal 120. In this case, the second spring section and the first spring section are used as common components having the same form, whereby cost reduction can be achieved due to the decrease in the number of components.

According to the first embodiment, in the internal conductor terminal 5 and the external conductor terminal 6, the internal terminal extension section 52 and the external terminal extension section 62 are disposed coaxially so as to be placed face-to-face with each other and to form a nearly cylindrical shape. From another point of view, the internal terminal extension section 52 and the external terminal extension section 62 are formed into nearly semi-cylindrical shapes having the same curvature and disposed coaxially as a one set so as to be opposed to each other and to form a nearly cylindrical shape. Hence, the internal conductor terminal 5 and the external conductor terminal 6 are not respectively required to be formed into a cylindrical shape. In addition, since the external conductor terminal 6 is not required to be positioned on the outside of the internal conductor terminal 5, the conductor terminals are not required to have sizes (cross-sectional areas) larger than those required for electrical connection. As a result, the configurations of the internal conductor terminal 5 and the external conductor terminal 6 are simplified, whereby processing cost can be reduced.

Moreover, in the first embodiment, the first spring section 52*a* is provided for the internal terminal extension section 52, and the second spring section 62*a* is provided for the external terminal extension section 62. Hence, the internal terminal extension section 52 and the external terminal extension section 62 are placed face-to-face with each other in a nearly cylindrical shape, whereby the first spring section 52*a* and the second spring section 62*a* are disposed coaxially so as to be opposed to each other in a nearly cylindrical shape. From another point of view, the first spring section 52*a* and the second spring section 62*a* are formed into nearly semi-cylindrical shapes having the same curvature and disposed coaxially as a one set so as to be opposed to each other and to form a nearly cylindrical shape. For this reason, the first spring section 52*a* and the second spring section 62*a* are not disposed so as to be overlapped with each other in the radial direction. Consequently, when the internal terminal extension section 52 and the terminal block internal terminal 110 are made contact with each other so that electrical connection can be established therebetween, it is possible to reduce the insertion load (insertion force) that is exerted when the internal conductor terminal 5 is inserted into the terminal block 100. Similarly, when the external terminal extension section 62 and the terminal block external terminal 120 are made contact with each other so that electrical connection can be established therebetween, it is possible to reduce the insertion load (insertion force) that is exerted when the external conductor terminal 6 is inserted into the terminal block 100. As a result, the workability of the terminal connection in the electric wire 1 can be improved.

The inner holder 7 is formed of a non-conductive member and disposed between the internal conductor terminal 5 and the external conductor terminal 6, thereby insulating these terminals from each other, also insulating the terminal section 22 of the internal conductor 2 and the terminal section 32 of the external conductor 3 from each other, and preventing short circuit between the terminals and between the conductors. The inner holder 7 has the inner holder connection section 71 formed into a nearly cylindrical shape having an inside diameter slightly larger than the outside diameter of the internal insulator 21, an internal terminal surrounding section 72 extended from the inner holder connection section 71 into a nearly semi-cylindrical shape so as to surround the outer circumference of the internal terminal connection section 51 of the internal conductor terminal 5, and an external terminal surrounding section 73 extended from the inner holder connection section 71 into a nearly semi-cylindrical shape so as to surround the inner circumference of the external terminal extension section 62 of the external conductor terminal 6 and so as to be opposed to the internal terminal surrounding section 72. The inner holder connection section 71 covers the outer peripheral portion of the internal insulator 21 on the base end side of the internal conductor 2 instead of the terminal section 22 thereof. The internal terminal surrounding section 72 is extended from the inner holder connection section 71 via the inner holder internal continuation section 74 being bent in a diameter expanding direction and continuous to the upper section (the upper end section on the terminal side in FIG. 2) of one end side of the inner holder connection section 71. Moreover, the external terminal surrounding section 73 is extended from the inner holder connection section 71 via the inner holder external continuation section 75 being bent in a diameter expanding direction and continuous to the lower section (the lower end section on the terminal side in FIG. 2) of the one end side of the inner holder connection section 71. In this case, the internal terminal surrounding section 72 and the external terminal surrounding section 73 are formed into nearly semi-cylindrical shapes having the same curvature and disposed coaxially as a one set so as to be opposed to each other and to have a nearly cylindrical shape.

The length (the dimension in the axial direction of the cylindrical shape) of the inner holder 7 may merely be set to a length capable of securing the conductor creepage insulation distance between the internal conductor 2 and the external conductor 3 and also capable of securing the terminal creepage insulation distance between the internal conductor terminal 5 and the external conductor terminal 6. In the first embodiment, as an example, the length of the inner holder 7 is set so that the connection portion between the internal conductor terminal 5 and the internal conductor 2 (the connection portion between the internal terminal connection section 51 and the terminal section 22) is insulated and so that the connection portion between the external conductor terminal 6 and the external conductor 3 (the connection portion between the external terminal connection section 61 and the terminal section 32) is insulated.

In the connection structure according to the first embodiment, terminal connection to the electric wire 1 is performed according to the following procedure. First, the external conductor terminal 6 is fitted from the side of the external terminal connection section 61 thereof on the outer peripheral portion of the internal insulator 21 on the base end side of the internal conductor 2 of the electric wire 1 instead of the terminal section 22 thereof to cover the outer peripheral portion. In this state, the inner holder 7 is fitted from the side of the inner holder connection section 71 to the terminal side (for example, the left side in FIG. 2) of the electric wire 1 and interferes (makes contact) with the peripheral edge on the terminal side of the external conductor 3, thereby being positioned by the outer circumference of the internal insulator 21. In the state in which the inner holder 7 is positioned as described above, the inner holder external continuation section 75 interferes with the external terminal continuation section 63 of the external conductor terminal 6. Then, the terminal section 32 of the external conductor 3 from which the external insulator 31 has been peeled off is placed on the outer circumference of the external terminal connection section 61. Hence, the internal insulator 21, the inner holder connection section 71, the external terminal connection section 61 and the terminal section 32 are overlapped in the radial direction of the electric wire 1 from the inside to the outside thereof (see FIG. 2). Furthermore, a ring member (hereafter referred to as an external conductor compression-bonding ring) 33 covers this overlapped portion (the outer circumference of the terminal section 32 of the external conductor 3 placed on the outer circumference of the external terminal connection section 61). The external conductor compression-bonding ring 33 has a diameter (more specifically, an inside diameter larger than the diameter of the overlapped portion (the terminal section 32)) equal to that of the electric wire 1 (the protection sheath 41) and can be deformed easily in a diameter shrinking direction when the outer peripheral portion thereof is crimped around the entire periphery. For example, a metal ring can be used as the external conductor compression-bonding ring 33. When the external conductor compression-bonding ring 33 covering the overlapped portion is crimped, the external terminal connection section 61 is compression-bonded to the terminal section 32. Hence, the external conductor terminal 6 is set to a state of being connected to the external conductor 3. Next, the internal conductor terminal 5 is inserted into the space inside the internal terminal surrounding section 72 of the inner holder 7 from the side of the internal terminal connection section 51 and makes contact with the terminal section 22 of the internal conductor 2. The internal conductor 2 faces the space inside the internal terminal surrounding section 72 of the inner holder 7 and is set to a state of being contactable with the flat face of the internal terminal connection section 51, and the internal conductor terminal 5 making contact with the terminal section 22 may merely be connected to the terminal section 22 by ultrasonic welding or the like. In this case, the internal terminal continuation section 53 interferes (makes contact) with the peripheral edge on the terminal side of the internal terminal surrounding section 72, whereby the internal conductor terminal 5 is positioned with respect to the terminal section 22. Hence, the internal conductor terminal 5 is set to a state of being connected to the internal conductor 2.

The terminal housing 8 has a double-cylinder structure in which a cylindrical section (hereafter referred to as an inside cylindrical section) 81 having an outside diameter smaller than the inside diameters of the internal terminal extension section 52 of the internal conductor terminal 5 and the external terminal extension section 62 of the external conductor terminal 6, these terminal extension sections being disposed coaxially so as to be opposed to each other and having a nearly cylindrical shape, and a cylindrical section (hereafter referred to as an outside cylindrical section) 82 having an inside diameter nearly equal to the outside diameters of the internal terminal extension section 52 and the external terminal extension section 62 are disposed coaxially. From another point of view, the inside cylindrical section 81 is formed into a cylindrical shape having an outside diameter smaller than the inside diameters of the internal terminal surrounding section 72 and the external terminal surrounding section 73 of the inner holder 7, these surrounding sections being disposed coaxially so as to be opposed to each other and having a nearly cylindrical shape, and the outside cylindrical section 82 is formed into a cylindrical shape having an inside diameter nearly equal to the outside diameters of the internal terminal surrounding section 72 and the external terminal surrounding section 73. Hence, the terminal housing 8 has a structure in which the outer peripheries of the internal conductor terminal 5 and the external conductor terminal 6 are respectively surrounded while the outside cylindrical section 82 makes close contact with the outer peripheries of the internal terminal extension section 52 and the external terminal extension section 62. Furthermore, in the terminal housing 8, the inside cylindrical section 81 can be disposed between the internal conductor terminal 5 and the external conductor terminal 6 (on the inner peripheral sides of these terminals), and the internal conductor terminal 5 and the external conductor terminal 6 are separated from each other by the inside cylindrical section 81 while being disposed coaxially and received in the outside cylindrical section 82. The terminal housing 8 is provided with a partition section 83 by which the inside cylindrical section 81 is partitioned in the axial direction of the cylindrical shape. When the internal conductor terminal 5 is received in the terminal housing 8, the partition section 83 makes contact with the internal terminal continuation section 53 and sandwiches the internal terminal continuation section 53 between the partition section 83 and the internal terminal surrounding section 72 of the inner holder 7, thereby holding the internal conductor terminal 5.

When the internal conductor terminal 5 and the external conductor terminal 6 are received in the terminal housing 8, in the state in which the internal conductor terminal 5 is connected to the internal conductor 2 and the external conductor terminal 6 is connected to the external conductor 3, the terminal housing 8 is moved from the terminal side toward the internal conductor terminal 5 and the external conductor terminal 6. Then, the inside cylindrical section 81 is disposed between the internal conductor terminal 5 and the external conductor terminal 6 (on the inner peripheral sides of these terminals), and the outside cylindrical section 82 is positioned on the outer peripheral sides of the internal conductor terminal 5 and the external conductor terminal 6. At the time, the outside cylindrical section 82 makes contact with the outer circumference of the internal terminal extension section 52 of the internal conductor terminal 5 and also makes contact with the external terminal extension section 62 of the external conductor terminal 6. Moreover, the partition section 83 makes contact with the internal terminal continuation section 53, whereby the internal terminal continuation section 53 is sandwiched between the partition section 83 and the internal terminal surrounding section 72 of the inner holder 7 and is held therebetween.

In this case, the outside cylindrical section 82 of the terminal housing 8 has a locking section (hereafter referred to as a housing locking section) 84 provided so as to protrude on the inner peripheral face thereof and a groove section (hereafter referred to as a housing groove section) 85 for elastically bending and deforming the housing locking section 84. The housing locking section 84 is composed of a first locking section (hereafter referred to as an internal terminal locking section) 84*a* that can be engaged with the opening section (hereafter referred to as an internal terminal opening section) 52*b* formed in the internal terminal extension section 52 of the internal conductor terminal 5 and a second locking section (hereafter referred to as an external terminal locking section) 84*b* that can be engaged with the opening section (hereafter referred to as an external terminal opening section) 62*b* formed in the external terminal extension section 62 of the external conductor terminal 6. The internal terminal locking section 84*a* and the external terminal locking section 84*b* are disposed so as to be opposed to each other with the cylinder axis of the outside cylindrical section 82 placed therebetween (with a phase difference of 180°). What's more, the housing groove section 85 is composed of a first groove section (hereafter referred to as an internal terminal locking section releasing groove) 85*a* for elastically bending and deforming the internal terminal locking section 84*a* and a second groove section (hereafter referred to as an external terminal locking section releasing groove) 85*b* for elastically bending and deforming the external terminal locking section 84*b*. The internal terminal locking section releasing groove 85*a* and the external terminal locking section releasing groove 85*b* are respectively disposed on the outsides of the internal terminal locking section 84*a* and the external terminal locking section 84*b* so as to be opposed to each other with the cylinder axis of the outside cylindrical section 82 placed therebetween (with a phase difference of 180°).

The internal terminal locking section 84*a* protrudes while the inner peripheral face of the outside cylindrical section 82 is gradually shrunk in diameter and inclined in a tapered shape from the base end side to the terminal side. That is to say, the internal terminal locking section 84*a* is configured such that a flexible arm extending in a cantilever shape along the internal terminal locking section releasing groove 85*a* has a locking protrusion. On the other hand, in the internal terminal opening section 52*b*, the portion provided with the first spring section 52*a* of the internal terminal extension section 52 is formed as a concave section that is recessed from the outer peripheral side to the inner peripheral side. Hence, when the terminal housing 8 is moved from the terminal side to the base end side so that the internal conductor terminal 5 is received in the terminal housing 8, the internal terminal locking section 84*a* is moved to the internal terminal opening section 52*b* along the outer peripheral face of the internal terminal extension section 52 while making contact with the outer peripheral face of the internal terminal extension section 52 and being elastically bent and deformed so as to be toppled toward the internal terminal locking section releasing groove 85*a*. When the internal terminal locking section 84*a* is moved to the internal terminal opening section 52*b*, the internal terminal locking section 84*a* is elastically bent and deformed to return to the original shape thereof so as to be contracted inward (in a diameter shrinking direction) and then falls into the internal terminal opening section 52*b*, whereby the locking section is engaged with the internal terminal opening section 52*b*. As a result, the internal terminal locking section 84*a* is locked by the internal terminal opening section 52*b*, whereby the outside cylindrical section 82 (more briefly, the terminal housing 8) is in a state of being positioned with respect to the internal conductor terminal 5.

The external terminal locking section 84*b* protrudes while the inner peripheral face of the outside cylindrical section 82 is gradually shrunk in diameter and inclined in a tapered shape from the base end side to the terminal side. That is to say, the external terminal locking section 84*b* is configured such that a flexible arm extending in a cantilever shape along the external terminal locking section releasing groove 85*b* has a locking protrusion. On the other hand, in the external terminal opening section 62*b*, the portion provided with the second spring section 62*a* of the external terminal extension section 62 is formed as a concave section that is recessed from the outer peripheral side to the inner peripheral side. Hence, when the terminal housing 8 is moved from the terminal side to the base end side so that the external conductor terminal 6 is received in the terminal housing 8, the external terminal locking section 84*b* is moved to the external terminal opening section 62*b* along the outer peripheral face of the external terminal extension section 62 while making contact with the outer peripheral face of the external terminal extension section 62 and being elastically bent and deformed so as to be toppled toward the external terminal locking section releasing groove 85*b*. When the external terminal locking section 84*b* is moved to the external terminal opening section 62*b*, the external terminal locking section 84*b* is elastically bent and deformed to return to the original shape thereof so as to be contracted inward (in a diameter shrinking direction) and then falls into the external terminal opening section 62*b*, whereby the locking section is engaged with the external terminal opening section 62*b*. As a result, the external terminal locking section 84*b* is locked by the external terminal opening section 62*b*, whereby the outside cylindrical section 82 (more briefly, the terminal housing 8) is in a state of being positioned with respect to the external conductor terminal 6.

As described above, when the terminal housing 8 is moved from the terminal side to the base end side so that the internal conductor terminal 5 and the external conductor terminal 6 are received into the terminal housing 8, the partition section 83 makes contact with the internal terminal extension section 52, whereby the internal terminal locking section 84*a* is locked by the internal terminal opening section 52*b* and the external terminal locking section 84*b* is locked by the external terminal opening section 62*b*. Hence, the inside cylindrical section 81 and the outside cylindrical section 82 (that is, the terminal housing 8) are positioned with respect to the internal conductor terminal 5 and the external conductor terminal 6.

The internal conductor terminal 5 and the external conductor terminal 6 received in the terminal housing 8 are prevented from dropping from the terminal housing 8 by a holder member (hereafter referred to as a rear holder) 9. The rear holder 9 is equipped with a bottom section (hereafter referred to as a rear holder bottom section) 91 having a through hole 91*a* into which the external insulator 31 of the electric wire 1 is inserted, a cylindrical wall section (hereafter referred to as a rear holder wall section) 92 extending from the rear holder bottom section 91 to the terminal side, and a cylindrical section (hereafter referred to as a rear holder cylinder section) 93 extending from the rear holder bottom section 91 to the terminal side. The hole diameter of the through hole 91*a* is set larger than the outside diameter of the external insulator 31. In the rear holder wall section 92, an opening section (hereafter referred to as a rear holder opening section) 92*a* for locking the locking section (hereafter referred to as a rear holder locking section) 82*a* provided so as to protrude on the outer peripheral face of the outside cylindrical section 82 of the terminal housing 8 is formed. The inside diameter of the rear holder cylinder section 93 is set slightly larger than the outside diameter of the external conductor compression-bonding ring 33 (that is, the outside diameter of the external conductor compression-bonding ring 33 after the ring is crimped so that the external conductor terminal 6 is connected to the external conductor 3), and the outside diameter thereof is set slightly smaller than the inside diameter of the outside cylindrical section 82 of the terminal housing 8. Hence, when the rear holder cylinder section 93 is fitted between the external conductor compression-bonding ring 33 and the outside cylindrical section 82 from the base end side and the rear holder locking section 82*a* is engaged with the edge section of the rear holder opening section 92*a*, the terminal housing 8 and the rear holder 9 are positioned and fixed with respect to the electric wire 1, and the internal conductor terminal 5 and the external conductor terminal 6 are prevented from dropping from the terminal housing 8. As a result, the internal conductor terminal 5, the external conductor terminal 6 and the terminal housing 8 can be easily assembled and integrated while the number of the fixing points is reduced. Besides, in the state in which the rear holder 9 is positioned and fixed with respect to the electric wire 1, the rear holder cylinder section 93 is positioned in a state in which the tip end thereof is made contact with the inner holder internal continuation section 74 of the inner holder 7.

The rear holder 9 may merely be in a state in which the through hole 91*a* of the rear holder bottom section 91 is fitted beforehand on the external insulator 31 from the terminal side before the internal conductor terminal 5 and the external conductor terminal 6 are connected to the internal conductor 2 and the external conductor 3 of the electric wire 1 and before the inner holder 7 is disposed between the internal conductor terminal 5 and the external conductor terminal 6. During the connection work of the internal conductor terminal 5 and the external conductor terminal 6 to the internal conductor 2 and the external conductor 3 described above, the rear holder 9 is retracted to the base end side of the external conductor 3 instead of the terminal section 32 thereof. Then, after the internal conductor terminal 5 and the external conductor terminal 6 are connected to the internal conductor 2 and the external conductor 3, respectively, and after the inner holder 7 is disposed between the internal conductor terminal 5 and the external conductor terminal 6 and received in the terminal housing 8, while the through hole 91*a* of the rear holder bottom section 91 makes contact with the external insulator 31, the rear holder 9 may merely be moved toward the terminal side along the external insulator 31 and the rear holder locking section 82*a* of the terminal housing 8 may merely be engaged with the rear holder opening section 92*a*. Therefore, in order that the peripheral edge of the rear holder wall section 92 abuts against and rises over the rear holder locking section 82*a* easily when the rear holder 9 is moved toward the terminal side, the abutting faces of the peripheral edge of the rear holder wall section 92 and the rear holder locking section 82*a* are inclined so as to be aligned with each other. Hence, the rear holder wall section 92 having abutted against the rear holder locking section 82*a* is elastically bent and deformed so as to be widened outward and rises over the rear holder locking section 82*a*, and then when the rear holder locking section 82*a* enters the rear holder opening section 92*a*, the rear holder wall section 92 is elastically bent and deformed to return to the original shape thereof. As a result, the rear holder locking section 82*a* can be engaged with the rear holder opening section 92*a*.

Furthermore, the rear holder 9 is equipped with a waterproof member (for example, a rubber plug) 10 to prevent the penetration of water into the internal conductor terminal 5 and the external conductor terminal 6 received in the terminal housing 8. The rubber plug 10 is made by forming an elastic rubber material into a ring shape and attached to the mounting protrusion 91*b* provided on the rear holder bottom section 91 so as to be integrated with the rear holder 9. Hence, a structure for preventing the rubber plug 10 from rotating is not required to be provided separately, and the structure for preventing the penetration of water can be simplified. However, the rubber plug 10 can be configured separately so that it can be separated from the rear holder 9. In addition, in the state in which the rubber plug 10 is positioned and fixed with respect to the electric wire 1 together with the rear holder 9 and the rear holder 9 is positioned and fixed, the rubber plug 10 is pressure-fitted and fastened to the portion (the outer peripheral portion of the external insulator 31 on the base end side instead of the terminal section 32) ahead of the terminal section 32 of the external conductor 3. The outside cylindrical section 82 is fitted on the outer circumference of the rubber plug 10 that has been pressure-fitted and fastened on the external insulator 31 as described above. In other words, the outside cylindrical section 82 is in a state of being positioned with respect to the external conductor terminal 6 (the external terminal locking section 84*b* is locked with the external terminal opening section 62*b*), and the rubber plug 10 is in a state of being fitted in the end section on the base end side of the inner circumference thereof. That is to say, the rubber plug 10 is disposed between the external insulator 31 of the electric wire 1 and the terminal housing 8 and seals the space therebetween on the base end side. Hence, it is possible to prevent the penetration of water (for example, the penetration of water along the external insulator 31 of the electric wire 1) into the internal conductor terminal 5 and the external conductor terminal 6 received in the terminal housing 8.

Still further, in the connection structure according to the first embodiment, the electric wire 1 is in a state in which the protection sheath 41 is peeled off and the shield conductor 4 is exposed, and a shielding member (hereafter referred to as a shield shell) 11 connected to the exposed portion (terminal section 42) of the shield conductor 4 is provided. The shield shell 11 is configured so as to surround the outer circumference of the outside cylindrical section 82 of the terminal housing 8 in which the internal conductor terminal 5 and the external conductor terminal 6 are received and to serve as a housing member for shielding the terminal housing 8 (that is, the terminal connection section of the electric wire 1).

The shield shell 11 has a bottom section (hereafter referred to as a shield shell bottom section) 111 having a through hole 111*a* into which the external insulator 31 of the electric wire 1 is passed, a cylindrical wall section (hereafter referred to as a shield shell wall section) 112 extending from the shield shell bottom section 111 to the terminal side, and a shield shell fixing section 113 extending in a flat shape from the shield shell wall section 112 to the outside (diameter expanding side). The diameter of the through hole 111*a* is set larger than the outside diameter of the external insulator 31. The inside diameter of the shield shell wall section 112 is set slightly larger than the outside diameters of the outside cylindrical section 82 and the rear holder wall section 92. Furthermore, an opening section (hereafter referred to as a shield shell opening section) 112*b* for locking a locking section (hereafter referred to as a shield shell locking section) 82*b* provided so as to protrude on the outer peripheral face of the outside cylindrical section 82 of the terminal housing 8 is formed in the shield shell wall section 112. Hence, when the shield shell wall section 112 is fitted on the outer peripheries of the rear holder wall section 92 and the outside cylindrical section 82 from the base end side and the shield shell locking section 82*b* is engaged with the edge section of the shield shell opening section 112*b*, the shield shell 11 is positioned and fixed with respect to the terminal housing 8 and the rear holder 9 (more briefly, the electric wire 1). In addition, the electric wire 1 is fixed to a predetermined mating connection device (for example, an electric component mounted on an automobile) via the shield shell 11. In this case, the exposed portion (the terminal section 42) of the shield conductor 4 from which the protection sheath 41 is peeled off is disposed so as to be mounted on the outer circumference of the shield shell 11, and connected to the outer peripheral face of the shield shell 11 by compression-bonding using a ring member 114 disposed so as to cover the outer circumference. Furthermore, the shield shell 11 is fixed to the mating connection device using the shield shell fixing section 113, and the electric wire 1 can be shielded, for example, by grounding the shield conductor 4 via the mating connection device.

The shield shell 11 may merely be in a state in which the through hole 111*a* of the shield shell bottom section 111 is fitted beforehand on the external insulator 31 from the terminal side before the internal conductor terminal 5 and the external conductor terminal 6 are connected to the internal conductor 2 and the external conductor 3 of the electric wire 1 and before the inner holder 7 is disposed between the internal conductor terminal 5 and the external conductor terminal 6. During the connection work of the internal conductor terminal 5 and the external conductor terminal 6 to the internal conductor 2 and the external conductor 3 described above, the shield shell 11 is retracted to the base end side of the external conductor 3 instead of the terminal section 32 thereof. Then, after the internal conductor terminal 5 and the external conductor terminal 6 are connected to the internal conductor 2 and the external conductor 3, respectively, after the inner holder 7 is disposed between the internal conductor terminal 5 and the external conductor terminal 6 and received in the terminal housing 8 and after the rear holder 9 is positioned and fixed with respect to the electric wire 1 (the rear holder locking section 82*a* is engaged with the rear holder opening section 92*a*), while the through hole 111*a* of the shield shell bottom section 111 makes contact with the external insulator 31, the shield shell 11 may merely be moved toward the terminal side along the external insulator 31 and the shield shell locking section 82*b* of the terminal housing 8 may merely be engaged with the shield shell opening section 112*b*. Therefore, in order that the peripheral edge (the bent portion where the shield shell wall section 112 continues to the shield shell fixing section 113) of the shield shell wall section 112 abuts against and rises over the shield shell locking section 82*b* easily when the shield shell 11 is moved toward the terminal side, the bent portion has the so-called rounded shape and the abutting face of the shield shell locking section 82*b* is inclined so as to be aligned with the rounded shape. Hence, the shield shell wall section 112 having abutted against the shield shell locking section 82*b* is elastically bent and deformed so as to be widened outward and rises over the shield shell locking section 82*b*, and then when the shield shell locking section 82*b* enters the shield shell opening section 112*b*, the shield shell wall section 112 is elastically bent and deformed to return to the original shape thereof. As a result, the shield shell locking section 82*b* can be engaged with the shield shell opening section 112*b*.

Figure 5A:
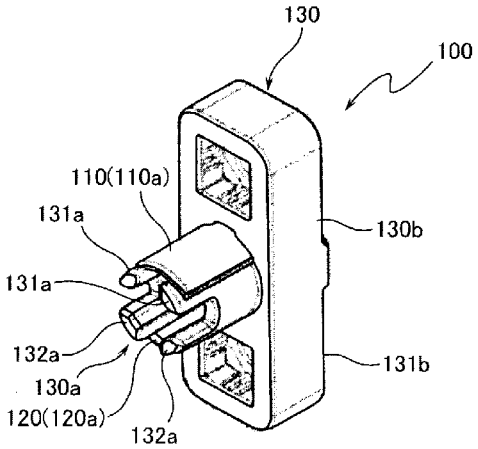
FIGS. 5A to 5C are views showing configurations of the terminal members (terminal block) of a mating connection device according to the first embodiment of the present invention.
Figure 5B:
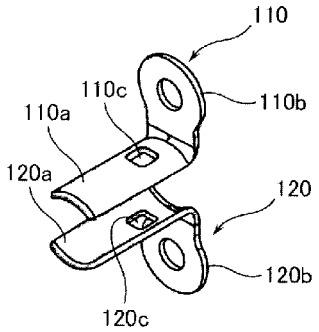
Figure 5C:
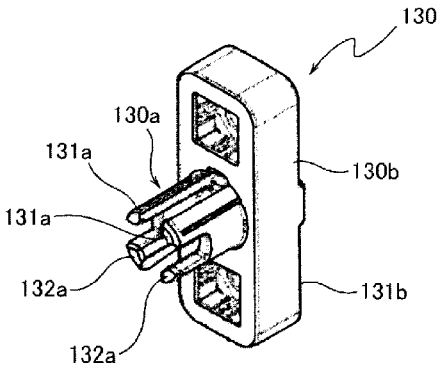
Figure 6:
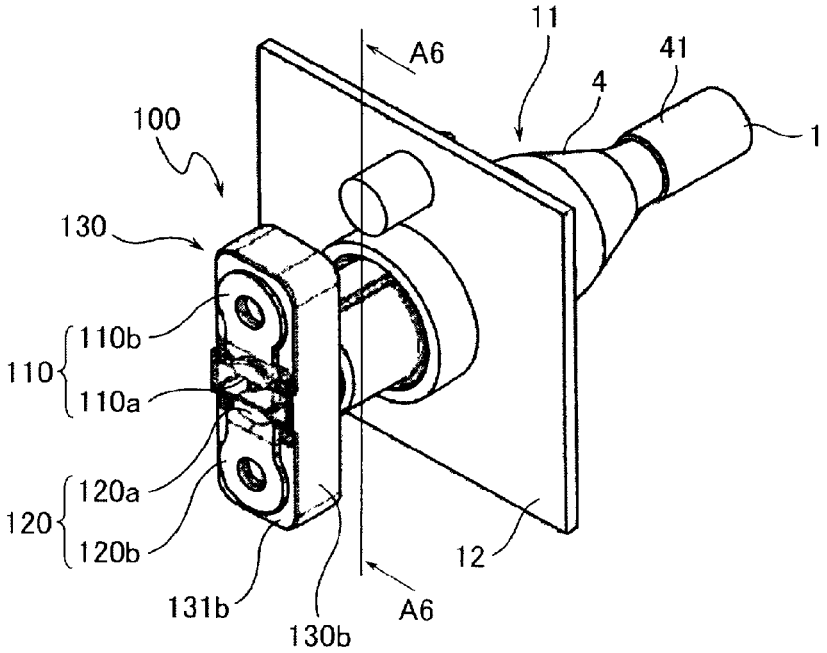
FIG. 6 is a perspective view showing a configuration of the terminal block shown in FIG. 5A in a state of being connected to the electric wire.

The internal conductor terminal 5 and the external conductor terminal 6 according to the first embodiment are connected to the terminal member (hereafter referred to as a terminal block) 100 in the mating connection device, and the electric wire 1 is electrically connected to the mating connection device via the terminal block 100. FIGS. 5A to 5C are perspective views showing a configuration of the terminal block 100 according to the first embodiment; FIG. 5A is a perspective view showing the entire configuration of the terminal block, FIG. 5B is a perspective view showing configurations of the connection terminals to be connected to the internal conductor terminal 5 and the external conductor terminal 6, and FIG. 5C is a perspective view showing a configuration of a housing member for accommodating the connection terminals. Furthermore, FIG. 6 is a perspective view showing a configuration of the terminal block 100 in a state of being connected to the electric wire 1. FIG. 2 corresponds to a view showing the vertical cross-section of the portion indicated by arrow A6 in FIG. 6 and viewed from the direction of the arrow.

As shown in FIG. 2 and FIGS. 5A to 5C, the terminal block 100 is equipped with a first terminal member (hereafter referred to as a terminal block internal terminal) 110 to be connected to the internal conductor terminal 5, a second terminal member (hereafter referred to as a terminal block external terminal) 120 to be connected to the external conductor terminal 6, and a housing member (hereafter referred to as a terminal block housing) 130 for holding the terminal block internal terminal 110 and the terminal block external terminal 120.

The terminal block internal terminal 110 has an internal terminal section 110*a* provided so as to extend in a nearly semi-cylindrical shape and an internal terminal contact section 110*b* provided so as to protrude from one end of the internal terminal section 110*a* in a diameter expanding direction in a flat plate shape. In addition, the terminal block external terminal 120 has an external terminal section 120*a* provided so as to extend in a nearly semi-cylindrical shape and an external terminal contact section 120*b* provided so as to protrude from one end of the external terminal section 120*a* in a diameter expanding direction in a flat plate shape. The terminal block internal terminal 110 and the terminal block external terminal 120 are received in the terminal block housing 130 while the internal terminal section 110*a* and the external terminal section 120*a* are disposed so as to be placed face-to-face with each other and to form a nearly cylindrical shape. From another point of view, the internal terminal section 110*a* and the external terminal section 120*a* are formed into nearly semi-cylindrical shapes having the same curvature and disposed coaxially as a one set so as to be opposed to each other and to form a nearly cylindrical shape. In this case, the internal terminal section 110*a* and the external terminal section 120*a* are respectively formed into nearly semi-cylindrical shapes having a curvature such that the outside diameter of the cylindrical shape formed by disposing the internal terminal section 110*a* and the external terminal section 120*a* coaxially so as to be opposed to each other is slightly smaller than the inside diameter of the nearly cylindrical shape formed by similarly disposing the internal terminal extension section 52 and the external terminal extension section 62 coaxially so as to be opposed to each other.

An opening section (hereafter referred to as a terminal block internal terminal opening section) 110*c* for locking a terminal block internal terminal locking section 130*c* provided on the terminal block housing 130 (terminal holding section 130*a*) to be described later is formed In the internal terminal section 110*a*. Hence, when the terminal block internal terminal locking section 130*c* is engaged with the edge section of the terminal block internal terminal opening section 110*c*, the terminal block internal terminal 110 is positioned and fixed with respect to the terminal block housing 130, and the terminal block internal terminal 110 is prevented from dropping from the terminal block housing 130. In addition, after the internal terminal section 110*a* is fitted into the inner circumference side of the internal terminal extension section 52 from the terminal side against the elastic force (pushing force) of the first spring section 52*a*, the contact state between the internal terminal section 110*a* and the first spring section 52*a* is held by the elastic force. As a result, the internal terminal section 110*a* is connected to the internal terminal extension section 52 via the first spring section 52*a*, and electrical connection can be established between the terminal block internal terminal 110 and the internal conductor terminal 5. In the state in which the internal terminal contact section 110*b* is held on the terminal block housing 130 together with the internal terminal section 110*a*, the internal terminal contact section 110*b* is exposed to the outside from the terminal block housing 130, whereby the internal terminal contact section 110*b* is configured so as to serve as an interface when the internal terminal section 110*a* (more briefly, the terminal block internal terminal 110) connected to the internal conductor terminal 5 is connected to the electric wire, bus bar or the like of the mating connection device.

An opening section (hereafter referred to as a terminal block external terminal opening section) 120*c* for locking a terminal block external terminal locking section 130*d* provided on the terminal block housing 130 (terminal holding section 130*a*) to be described later is formed in the external terminal section 120*a*. Hence, when the terminal block external terminal locking section 130*d* is engaged with the edge section of the terminal block external terminal opening section 120*c*, the terminal block external terminal 120 is positioned and fixed with respect to the terminal block housing 130, and the terminal block external terminal 120 is prevented from dropping from the terminal block housing 130. In addition, after the external terminal section 120*a* is fitted into the inner circumference side of the external terminal extension section 62 from the terminal side against the elastic force (pushing force) of the second spring section 62*a*, the contact state between the external terminal section 120*a* and the second spring section 62*a* is held by the elastic force. As a result, the external terminal section 120*a* is connected to the external terminal extension section 62 via the second spring section 62*a*, and electrical connection can be established between the terminal block external terminal 120 and the external conductor terminal 6. In the state in which the external terminal contact section 120*b* is held on the terminal block housing 130 together with the external terminal section 120*a*, the external terminal contact section 120*b* is exposed to the outside from the terminal block housing 130, whereby the external terminal contact section 120*b* is configured so as to serve as an interface when the external terminal section 120*a* (more briefly, the terminal block external terminal 120) connected to the external conductor terminal 6 is connected to the electric wire, bus bar or the like of the mating connection device.

In the first embodiment, it is assumed that the terminal block internal terminal 110 and the terminal block external terminal 120 are configured as common components having the same form. With this continuation, cost reduction can be achieved by decreasing the number of components. In addition, the terminal block internal terminal 110 and the terminal block external terminal 120 are not required to be formed into a cylindrical shape. In addition, since the terminal block external terminal 120 is not required to be positioned on the outside of the terminal block internal terminal 110, the terminal block internal terminal 110 and the terminal block external terminal 120 are not required to have sizes (cross-sectional areas) larger than those required for electrical connection. As a result, the configurations of the terminal block internal terminal 110 and the terminal block external terminal 120 can be simplified, and processing cost can be reduced. However, it is possible to assume that the terminal block internal terminal and the terminal block external terminal are configured as separate components having different forms.

The terminal block housing 130 has the terminal holding section 130*a* for holding the internal terminal section 110*a* and the external terminal section 120*a* and a terminal contact holding section 130*b* for holding the internal terminal contact section 110*b* and the external terminal contact section 120*b*. The terminal holding section 130*a* is composed of two first terminal holding sections (hereafter referred to internal terminal holding sections) 131*a* extending along the inner circumference of the internal terminal section 110*a* so as to hold the internal terminal section 110*a* and two second terminal holding sections (hereafter referred to external terminal holding sections) 132*a* extending along the inner circumference of the external terminal section 120*a* so as to hold the external terminal section 120*a*. The internal terminal holding sections 131*a* and the external terminal holding sections 132*a* are disposed so as to be opposed to each other while a space having a diameter slightly larger than the outside diameter of the inside cylindrical section 81 of the terminal housing 8 is provided therebetween.

The internal terminal holding section 131*a* is provided with the locking section (hereafter referred to as the terminal block internal terminal locking section) 130*c* for locking the internal terminal section 110*a* of the terminal block internal terminal 110 inserted from the terminal side. In this case, the terminal block internal terminal locking section 130*c* is integrated with the internal terminal holding section 131*a* so as to be extended to the outside of the internal terminal holding section 131*a* in a cantilever shape. Hence, when the terminal block internal terminal locking section 130*c* having the so-called spring structure is engaged with the edge section of the terminal block internal terminal opening section 110*c*, the terminal block internal terminal 110 is positioned and fixed with respect to the terminal block housing 130, and the terminal block internal terminal 110 is prevented from dropping from the terminal block housing 130.

Furthermore, the external terminal holding section 132*a* is provided with the locking section (hereafter referred to as the terminal block external terminal locking section) 130*d* for locking the external terminal section 120*a* of the terminal block external terminal 120 inserted from the terminal side. In this case, the terminal block external terminal locking section 130*d* is integrated with the external terminal holding section 132*a* so as to be extended to the outside of the external terminal holding section 132*a* in a cantilever shape. Hence, when the terminal block external terminal locking section 130*d* having the so-called spring structure is engaged with the edge section of the terminal block external terminal opening section 120*c*, the terminal block external terminal 120 is positioned and fixed with respect to the terminal block housing 130, and the terminal block external terminal 120 is prevented from dropping from the terminal block housing 130.

Then, together with the terminal block internal terminal 110 and the terminal block external terminal 120 having been positioned and fixed to the terminal block housing 130, the terminal holding section 130*a* (the internal terminal holding sections 131*a* and the external terminal holding sections 132*a*) is fitted on the inside cylindrical section 81 of the terminal housing 8. Hence, the internal terminal section 110*a* is fitted into the inner circumference side of the internal terminal extension section 52 against the elastic force (pushing force) of the first spring section 52*a*, and the internal terminal section 110*a* is made contact with the first spring section 52*a* by the elastic force. In other words, the internal terminal section 110*a* is connected to the internal terminal extension section 52 via the first spring section 52*a*, whereby electrical connection can be established between the terminal block internal terminal 110 and the internal conductor terminal 5. In this state, the internal terminal holding section 131*a* is positioned in a state in which the tip end (the end section on the base end side (the right end section in FIG. 2)) thereof is made contact with the partition section 83 of the terminal housing 8. Similarly, the external terminal section 120*a* is fitted into the inner circumference side of the external terminal extension section 62 against the elastic force (pushing force) of the second spring section 62*a*, and the external terminal section 120*a* is made contact with the second spring section 62*a* by the elastic force. In other words, the external terminal section 120*a* is connected to the external terminal extension section 62 via the second spring section 62*a*, whereby electrical connection can be established between the terminal block external terminal 120 and the external conductor terminal 6. In this state, the external terminal holding section 132*a* is positioned in a state in which the tip end (the end section on the base end side (the right end section in FIG. 2)) thereof is made contact with the partition section 83 of the terminal housing 8.

As a result, the terminal block internal terminal 110 and the terminal block external terminal 120 are integrally assembled with the terminal holding section 130*a* (the internal terminal holding sections 131*a* and the external terminal holding sections 132*a*). In this state, the terminal block housing 130 is in a state in which the terminal block internal terminal 110 and the terminal block external terminal 120 are disposed coaxially while being separated from each other and held by the terminal holding section 130*a*. In other words, the terminal block internal terminal 110 and the terminal block external terminal 120 are disposed so as to be separated from each other with a constant distance therebetween in the state in which they are held by the terminal block housing 130. The terminal contact holding section 130*b* is configured so as to have a contact face 131*b* which protrudes from the outer circumference of the terminal holding section 130*a*, with which the internal terminal contact section 110*b* and the external terminal contact section 120*b* are made contact and on which the contact sections are held. Hence, in the terminal contact holding section 130*b*, in the state in which the terminal block internal terminal 110 and the terminal block external terminal 120 are integrally assembled, the internal terminal contact section 110*b* and the external terminal contact section 120*b* are made contact with and held on the contact face 131*b*.

As described above, the terminal block 100 in which the terminal block internal terminal 110 and the terminal block external terminal 120 are assembled on the terminal block housing 130 and integrated is connected to the electric wire 1. More specifically, the internal terminal section 110*a* of the terminal block internal terminal 110 is connected to the internal conductor terminal 5, and the external terminal section 120*a* of the terminal block external terminal 120 is connected to the external conductor terminal 6. At the time, the electric wire 1 is fitted in the terminal block 100 so that the tip end (the end section on the base end side (the right end section in FIG. 2)) of the terminal holding section 130*a* (the internal terminal holding sections 131*a* and the external terminal holding sections 132*a*) is made contact with the partition section 83 of the terminal housing 8, whereby the internal conductor terminal 5 and the internal terminal section 110*a* can be positioned in their connection states, and the external conductor terminal 6 and the external terminal section 120*a* can also be positioned in their connection states. Furthermore, the internal terminal contact section 110*b* of the terminal block internal terminal 110 connected to the internal conductor terminal 5 and the external terminal contact section 120*b* of the terminal block external terminal 120 connected to the external conductor terminal 6 are connected to the electric wire, bus bar or the like of the mating connection device, whereby the electric wire 1 can be electrically connected to the mating connection device at the terminal block 100. The electric wire 1 connected to the terminal block 100 is fixed to the holding member 12 of the mating connection device using a fixing member 13, such as a screw, via the shield shell 11 (the shield shell fixing section 113) (see FIG. 2).

With the connection structure according to the first embodiment described above, the internal conductor terminal 5 and the external conductor terminal 6 are disposed coaxially so as to be separated from each other, whereby the size of the terminal connection portion of the electric wire 1 composed of the internal conductor terminal 5, the external conductor terminal 6, the inner holder 7, the terminal housing 8, etc. can be made compact. In addition, the internal terminal extension section 52 and the external terminal extension section 62 are formed into a nearly semi-cylindrical shape and disposed so as to be opposed to each other to form a nearly cylindrical shape. Hence, the configurations of the internal conductor terminal 5 and the external conductor terminal 6 are simplified, whereby processing cost can be reduced. Furthermore, since the internal terminal extension section 52 and the external terminal extension section 62 are disposed so as to be placed face-to-face with each other and to form a nearly cylindrical shape, the first spring section 52*a* and the second spring section 62*a* are disposed as a one set so as to be opposed to each other and to form a nearly cylindrical shape, whereby they are not disposed so as to be overlapped with each other in the radial direction. Consequently, the insertion load (insertion force) that is exerted when the internal conductor terminal 5 and the external conductor terminal 6 are inserted into the terminal block 100 is reduced, whereby the workability of the terminal connection in the electric wire 1 can be improved. In addition, in the terminal block 100 according to the first embodiment, the terminal block internal terminal 110 and the terminal block external terminal 120 are coaxially disposed so as to be separated from each other. Hence, by using the terminal block 100 for the connection between the electric wire 1 and the mating connection device, the size of the terminal connection portion of the mating connection device can also be made compact; as a result, the size of the terminal connection portion of the electric wire 1 can be made more compact. Furthermore, as in the case of the internal conductor terminal 5 and the external conductor terminal 6, the configurations of the terminal block internal terminal 110 and the terminal block external terminal 120 are simplified and processing cost is reduced.

In the first embodiment described above, the internal conductor terminal 5 (the internal terminal extension section 52) serving as the first terminal and the external conductor terminal 6 (the external terminal extension section 62) serving as the second terminal are disposed coaxially in the extension direction of the electric wire 1; however, even if the first terminal and the second terminal are disposed coaxially in a direction bent from the extension direction of the electric wire 1, a similar operating advantage can be obtained. Such a configuration modified as described above will be described below as a second embodiment according to the present invention. Since the basic configuration of the second embodiment is similar to that of the first embodiment described above, the same components as those of the first embodiment or components similar thereto are designed by the same reference numerals in the drawings, and the differences from the first embodiment will be described below.

Second Embodiment

Figure 7:
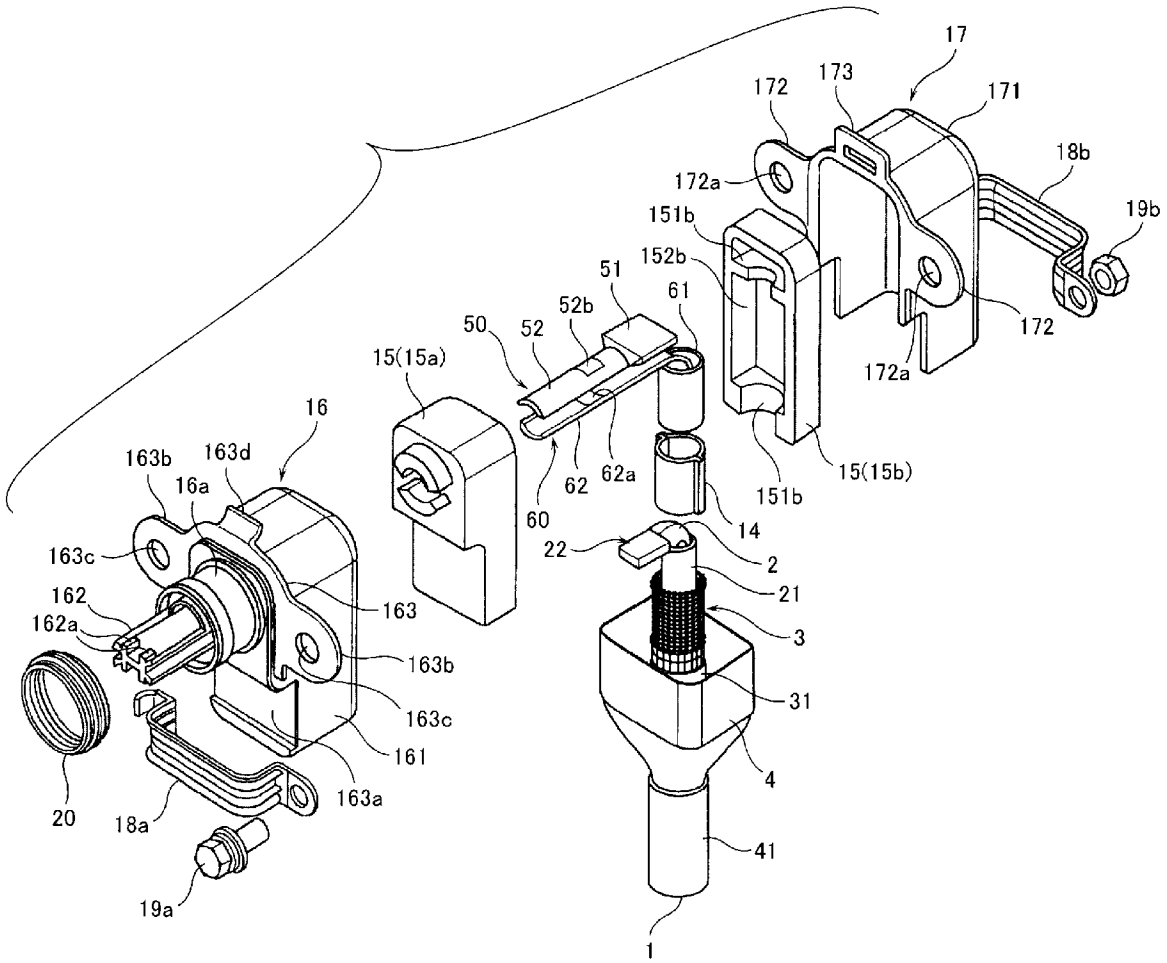
FIG. 7 is a perspective view showing a terminal connection structure for an electric wire according to a second embodiment of the present invention with the components thereof disassembled.
Figure 8A:
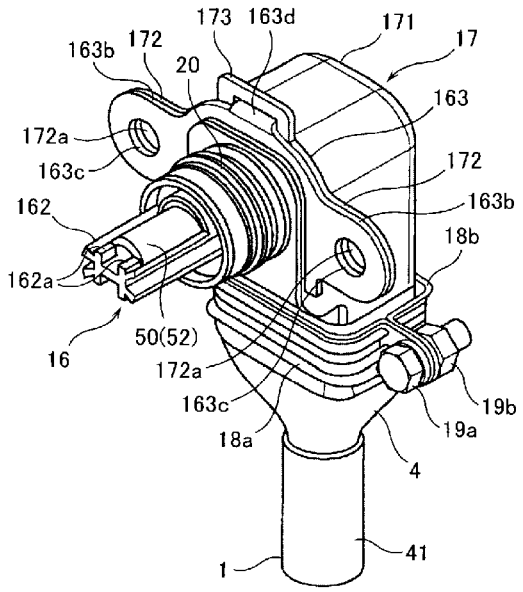
FIGS. 8A and 8B are perspective views showing the whole of the terminal connection structure for the electric wire according to the second embodiment of the present invention.
Figure 8B:
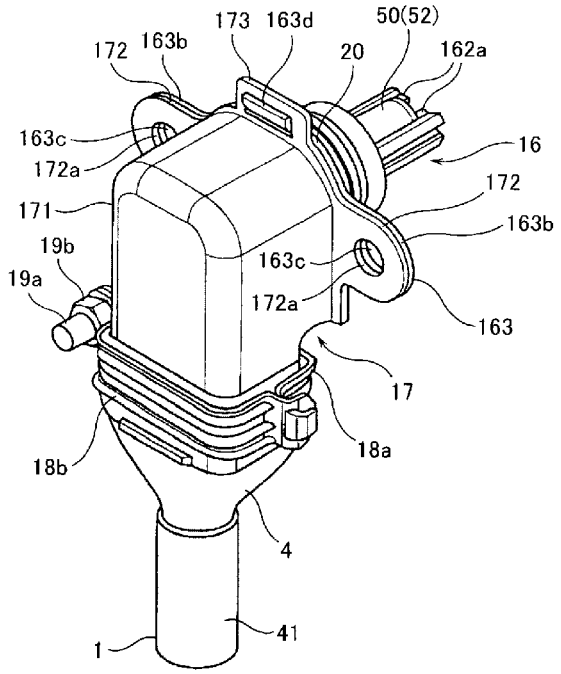
Figure 9:
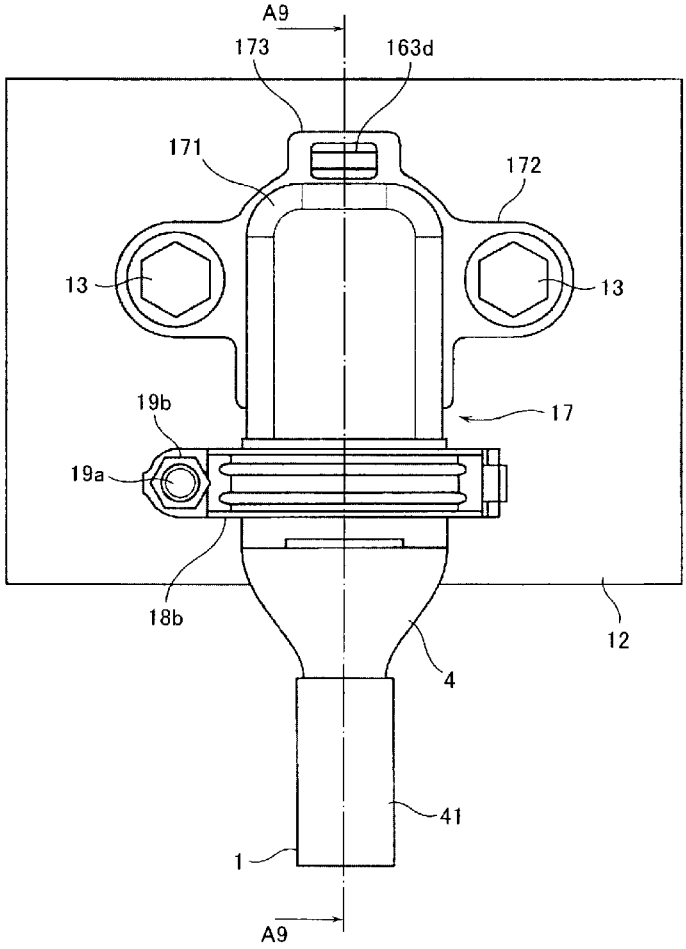
FIG. 9 is a plan view showing a state in which the terminal connection structure for the electric wire according to the second embodiment of the present invention is fixed to the mating connection device.
Figure 10:
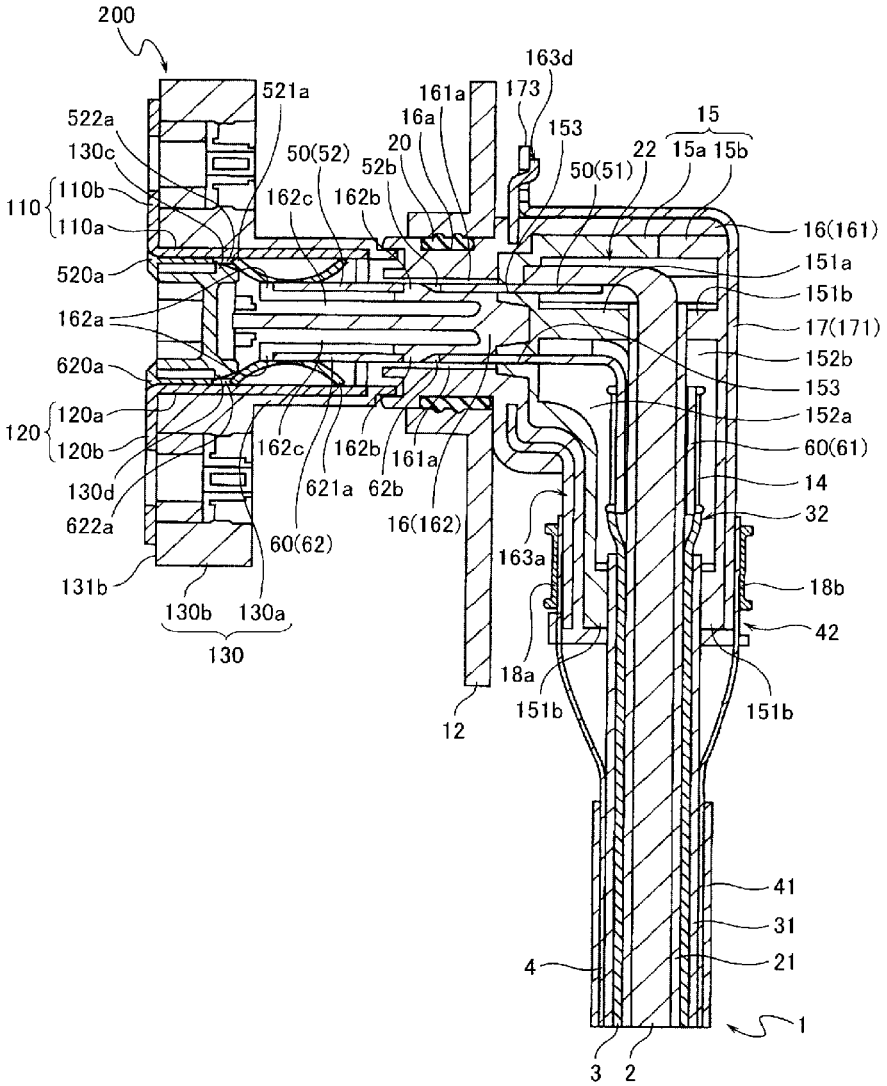
FIG. 10 is a view showing the vertical cross-section of the portion indicated by arrow A9 in FIG. 9 and viewed from the direction of the arrow.

FIGS. 7 to 10 show a connection structure according to the second embodiment of the present invention. FIG. 7 is a perspective view showing the connection structure with the components thereof disassembled. FIGS. 8A and 8B are perspective views showing the whole of the connection structure; FIG. 8A is a perspective view showing a state in which the components shown in FIG. 7 are assembled, viewed from the terminal side, and FIG. 8B is a perspective view showing the state in which the components are assembled, viewed from the side opposite to that shown in FIG. 8A. Furthermore, FIG. 9 is a plan view showing a state in which the connection structure is fixed to a mating connection device, and FIG. 10 is a view showing the vertical cross-section of the portion indicated by arrow A9 in FIG. 9 and viewed from the direction of the arrow.

Although the connection structure according to the first embodiment (see FIGS. 1 and 2) is a straight type in which the electric wire 1 and the mating connection device are connected in the extension direction of the electric wire 1, the connection structure according to the second embodiment is an L-type in which the electric wire 1 and the mating connection device are connected at nearly right angles. Hence, in the second embodiment, an internal conductor terminal (first terminal) 50 and an external conductor terminal (second terminal) 60 are disposed coaxially in a direction (the lateral direction in FIG. 10, hereafter referred to as a connection direction) being bent at nearly right angles from the extension direction of the electric wire 1 (the vertical direction in FIG. 10).

As shown in FIGS. 7 to 10, the internal conductor terminal 50 has an internal terminal connection section 51 formed into a flat plate shape and an internal terminal extension section 52 extended from one end of the internal terminal connection section 51 in a nearly semi-cylindrical shape. The external conductor terminal 60 has an external terminal connection section 61 formed into a nearly cylindrical shape and an external terminal extension section 62 bent from one end of the external terminal connection section 61 and extended in a nearly semi-cylindrical shape. Furthermore, the internal conductor terminal 50 and the external conductor terminal 60 are disposed coaxially in the connection direction so that the internal terminal extension section 52 and the external terminal extension section 62 are placed face-to-face with each other so as to form a nearly cylindrical shape.

The connection of the internal conductor terminal 50 and the external conductor terminal 60 to the electric wire 1 is performed according to the following procedure. First, the external terminal connection section 61 of the external conductor terminal 60 is fitted on the outer circumference of the internal insulator 21 of the electric wire 1, and the terminal section 32 of the external conductor 3 is disposed so as to be mounted on the outer circumference thereof. Then, the external terminal connection section 61 is compression-bonded to the terminal section 32 by the sleeve 14 that is placed so as to cover the outer circumference of the terminal section 32, whereby the external conductor terminal 60 is connected to the external conductor 3. Next, the terminal section 22 of the internal conductor 2 is inserted into the external terminal connection section 61, and the internal terminal connection section 51 is joined by ultrasonic welding or the like to the terminal section 22 exposed from the external terminal connection section 61, whereby the internal conductor terminal 50 is connected to the internal conductor 2. Before or after the joint between the internal terminal connection section 51 and the terminal section 22, the terminal section 22 is bent in the connection direction so that the internal terminal extension section 52 is placed face-to-face with the external terminal extension section 62. As a result, the internal conductor terminal 50 and the external conductor terminal 60 are disposed coaxially in the connection direction so that the internal terminal extension section 52 and the external terminal extension section 62 are placed face-to-face with each other so as to form a nearly cylindrical shape.

The internal conductor terminal 50 and the external conductor terminal 60 disposed as described above are sealed from the outside using a sealing member (hereafter referred to as a packing) 15. The packing 15 is formed of a non-conductive member, such as resin, and has a divided structure in which a bottom section 15*a* and a lid section 15*b* are assembled and integrated on both sides in the connection direction. The bottom section 15*a* and the lid section 15*b* have support sections 151*a* and 151*b* for supporting the electric wire 1 while holding the wire 1 from both sides in the connection direction and accommodating sections 152*a* and 152*b* for accommodating the connection portion (hereafter referred to as the terminal connection portion of the electric wire 1) between the electric wire 1 supported by the support sections 151*a* and 151*b* and the internal conductor terminal 50 and the external conductor terminal 60, respectively. The bottom section 15*a* and the lid section 15*b* having been assembled are configured so as to be made contact with each other on the terminal side (the upper part in FIG. 10), and in the assembled state of the bottom section 15*a* and the lid section 15*b*, the support sections 151*a* and 151*b* are configured so as to make contact with the internal insulator 21 and the external insulator 31 of the electric wire 1. Consequently, when the bottom section 15*a* and the lid section 15*b* are assembled and integrated, the terminal connection portion of the electric wire 1 is covered and sealed, and the penetration of water (for example, the penetration of water along the external insulator 31 of the electric wire 1) into the internal conductor terminal 50 and the external conductor terminal 60 is prevented. Furthermore, the packing 15 is disposed between the internal conductor terminal 50 and the external conductor terminal 60 to insulate them, thereby also having a function of preventing short circuit. In addition, openings (hereafter referred to as packing opening sections) 153 are formed in the bottom section 15*a* on both sides while the support section 151*a* making contact with the internal insulator 21 is held therebetween. The internal terminal extension section 52 and the external terminal extension section 62 are respectively inserted into the packing opening sections 153, thereby being positioned while being placed face-to-face with each other in a state in which the internal terminal extension section 52 and the external terminal extension section 62 are exposed to the outside from the bottom section 15*a* having been assembled with the lid section 15*b*. Moreover, the bottom section 15*a* in which the internal terminal extension section 52 and the external terminal extension section 62 are positioned as described above is assembled with the lid section 15*b* and integrated into the packing 15

The integrated packing 15 is covered with a terminal housing 16 and a shield shell 17 assembled on both sides in the connection direction. In this case, the terminal housing 16 covers the bottom section 15*a* from one side in the connection direction and the shield shell 17 covers the lid section 15*b* from the other side in the connection direction, and the terminal housing 16 and the shield shell 17 are assembled by securing shield holders 18*a* and 18*b* with a bolt 19*a* and a nut 19*b*.

The terminal housing 16 has a housing body section 161 formed so as to cover the surface of the bottom section 15*a*, a terminal holding section 162 by which the internal conductor terminal 50 and the external conductor terminal 60 are held coaxially while being separated from each other, and an insert plate 163 formed on the housing body section 161 by insert molding. An opening (hereafter referred to as a housing opening section) 161*a* into which the internal terminal extension section 52 and the external terminal extension section 62 having been exposed from the bottom section 15*a* are inserted is formed in the housing body section 161, whereby the internal terminal extension section 52 and the external terminal extension section 62 having been inserted into the housing opening section 161*a* are exposed to the outside from the housing body section 161 having been used to cover the bottom section 15*a*. The terminal holding section 162 holds the internal terminal extension section 52 and the external terminal extension section 62 having been exposed from the housing body section 161 in the extension direction thereof. As a result, the internal conductor terminal 50 and the external conductor terminal 60 are positioned so as to be connectable to the terminal members (the terminal block internal terminal and the terminal block external terminal of the terminal block) of the mating connection device.

The terminal holding section 162 is provided with positioning protrusions 162*a* at the tip end sections of the internal terminal extension section 52 and the external terminal extension section 62 in the extension direction thereof and is also provided with locking protrusions 162*b* ahead of the positioning protrusions 162*a*. The positioning protrusions 162*a* and the locking protrusions 162*b* are provided so as to protrude from a flexible arm extending in a cantilever shape along holding section release grooves 162*c*. When the internal conductor terminal 50 and the external conductor terminal 60 are received in the terminal housing 16, the engaging protrusions 162*b* are moved to the opening sections (the internal terminal opening section 52*b* and the external terminal opening section 62*b*) formed in the internal terminal extension section 52 and the external terminal extension section 62 along the inner peripheral faces of the internal terminal extension section 52 and the external terminal extension section 62 while make contact with the inner peripheral faces and being elastically bent and deformed so as to be toppled toward the holding section release grooves 162*c*. When the locking protrusions 162*b* are moved to the internal terminal opening section 52*b* and the external terminal opening section 62*b*, the locking protrusions 162*b* are elastically bent and deformed to return to the original shape thereof so as to be widened outward (in a diameter expanding direction) and then engaged with the internal terminal opening section 52*b* and the external terminal opening section 62*b*. The positioning protrusions 162*a* serve as the positioning stoppers for the internal terminal extension section 52 and the external terminal extension section 62 having been inserted into the housing opening section 161*a*. Hence, when the internal conductor terminal 50 and the external conductor terminal 60 are received in the terminal housing 16, the internal terminal extension section 52 and the external terminal extension section 62 are positioned in a state of being properly exposed from the housing body section 161 when the internal terminal extension section 52 and the external terminal extension section 62 are slid along the terminal holding section 162 until they make contact with the positioning protrusions 162*a*. In this case, after elastically bent and deformed together with the locking protrusions 162*b*, the positioning protrusions 162*a* being in a state of having been elastically bent and deformed and then returned to the original shape thereof simultaneously with the locking protrusions 162*b* make contact with the internal terminal extension section 52 and the external terminal extension section 62, thereby positioning the internal terminal extension section 52 and the external terminal extension section 62 with respect to the terminal holding section 162 (more briefly, the terminal housing 8).

The insert plate 163 is a member formed, for example, by pressing a metal plate and has a mounting section 163*a* on which the shield holder 18*a* is mounted and fixing sections 163*b* for fixing the electric wire 1 to the mating connection device. The mounting section 163*a* is exposed along the bottom face of the mounting groove which is formed in the housing body section 161 and in which the shield holder 18*a* is mounted, and the fastening force from the shield holder 18*a* mounted in the mounting groove is exerted to the mounting section 163*a*. The fixing sections 163*b* being used as a pair are formed so as to protrude from the housing body section 161 and provided with fixing holes 163*c* into which fixing members (for example, bolts) are inserted.

The shield shell 17 has a shell body section 171 formed so as to cover the lid section 15*b* and protrusion sections 172 protruding from the shell body section 171. The shell body section 171 is a housing that is formed so as to cover the surface of the lid section 15*b*. The protrusion sections 172, serving as fixing portions when the electric wire 1 is fixed to the mating connection device, are used as a pair and protrude from the peripheral edge of the shell body section 171 so as to be able to be overlapped with the fixing sections 163*b* of the terminal housing 16 (the insert plate 163), and are provided with fixing holes 172*a* into which fixing members (for example, bolts) are inserted so that the fixing holes 172*a* can communicate with the fixing holes 163*c*.

One of the insert plate 163 and the shield shell 17 is provided with an engaging section and the other is provided with a section to be engaged. Furthermore, when the engaging section and the section to be engaged are engaged with each other, the terminal housing 16 and the shield shell 17 are assembled. In the second embodiment, a hook-shaped engaging section (hereafter referred to as a hook section) 163*d* is provided on the insert plate 163, and a section to be engaged (hereafter referred to as a hole section) 173 having an opening into which the hook section 163*d* is inserted so as to be engaged therewith is provided in the shield shell 17.

In the state in which the hook section 163*d* is engaged with the hole section 173 and the terminal housing 16 and the shield shell 17 are assembled, the shield conductor 4 is connected to the mounting section 163*a* of the insert plate 163 and the shell body section 171. At the time of the connection, the shield holders 18*a* and 18*b* are respectively disposed so that the terminal section 42 of the shield conductor 4 is mounted on the outer peripheries of the mounting section 163*a* and the shell body section 171, and the shield holders 18*a* and 18*b* are attached to the outer circumference of the terminal section 42. The shield holders 18*a* and 18*b* are engaged with each other on one end sides thereof having a band shape and are secured to each other on the other end sides using the bolt 19*a* and the nut 19*b*, whereby the terminal section 42 of the shield conductor 4 is connected to the outer peripheries of the mounting section 163*a* and the shell body section 171 by compression-bonding.

Moreover, in the state in which the terminal housing 16 and the shield shell 17 are assembled, the fixing sections 163*b* of the insert plate 163 and the protrusion sections 172 of the shell body section 171 are overlapped, whereby the fixing holes 163*c* communicate with the fixing holes 172*a*. As a result, as shown in FIG. 9, the electric wire 1 is fixed to the holding member 12 of the mating connection device using the fixing members (for example, screws) 13 inserted into the fixing holes 163*c* and 172*a*.

Still further, a mounting groove 16*a* on which a sealing member (hereafter referred to as a housing packing) 20 is mounted is formed in the terminal housing 16. When the housing packing 20 is mounted in this mounting groove 16*a* and closely made contact with the peripheral edge of the front portion (a fitting inlet formed in the holding member 12 into which the internal conductor terminal 50 and the external conductor terminal 60 are fitted) of the mating connection device, the penetration of water into the terminal connection portion of the electric wire 1, for example, is prevented. Although the housing packing 20 may merely be configured so that it can be separated from the terminal housing 16, the housing packing may be configured so as to be integrated with the terminal housing 16.

The internal conductor terminal 50 and the external conductor terminal 60 are connected to the terminal members (the terminal block internal terminal and the terminal block external terminal of the terminal block) of the mating connection device, and the electric wire 1 is elastically connected to the mating connection device via the terminal block. In the second embodiment, the basic configuration of the terminal block 200 of the second embodiment is similar to that of the terminal block 100 (see FIGS. 5A to 5C) of the first embodiment, the same components as those of the first embodiment or components similar thereto are designed by the same reference numerals in the drawings and the descriptions thereof are omitted. Since the first and second spring sections of the second embodiment are different in configuration from those of the first embodiment, the configurations of these spring sections will be described below.

Figure 11:
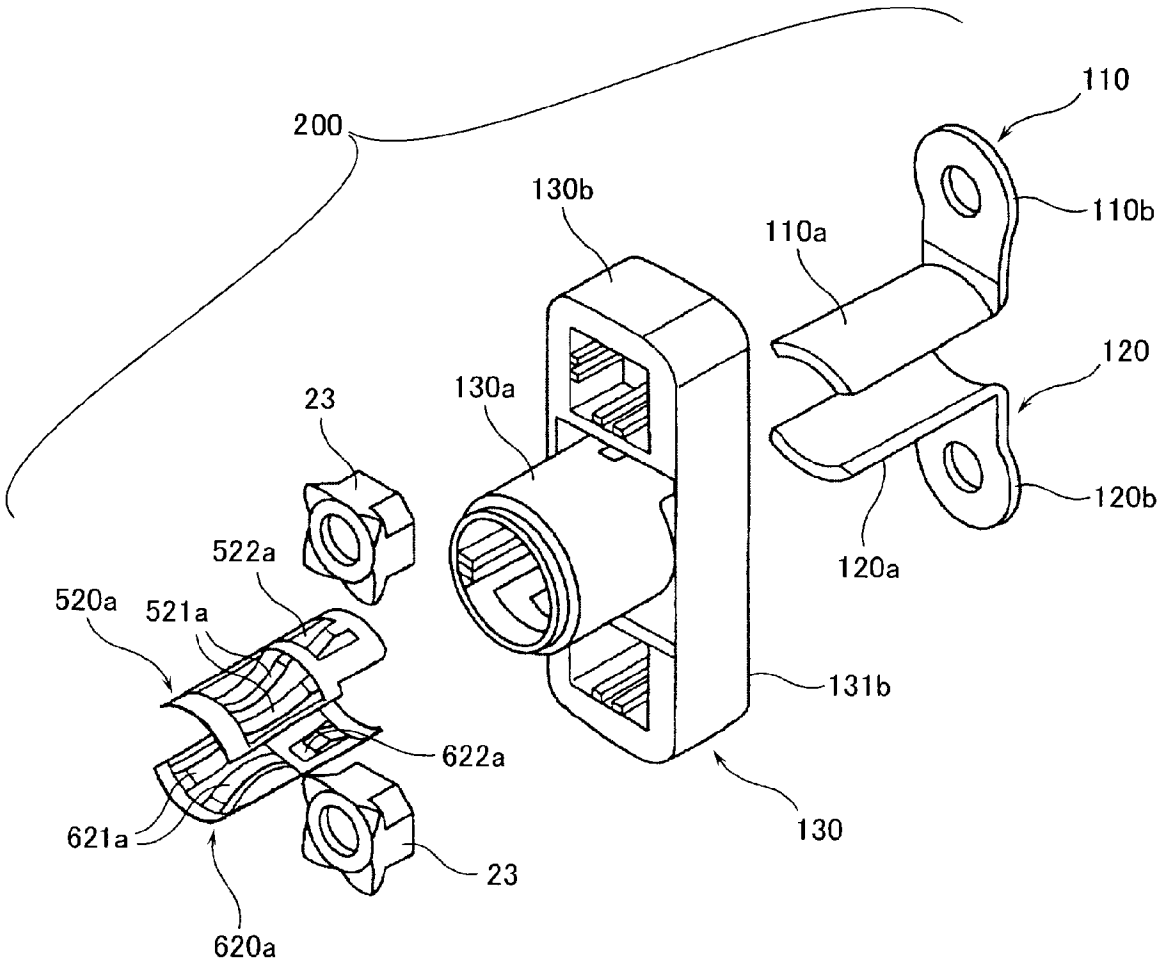
FIG. 11 is a perspective view showing the terminal members (terminal block) of the mating connection device according to the second embodiment of the present invention with the components thereof assembled.
Figure 12A:
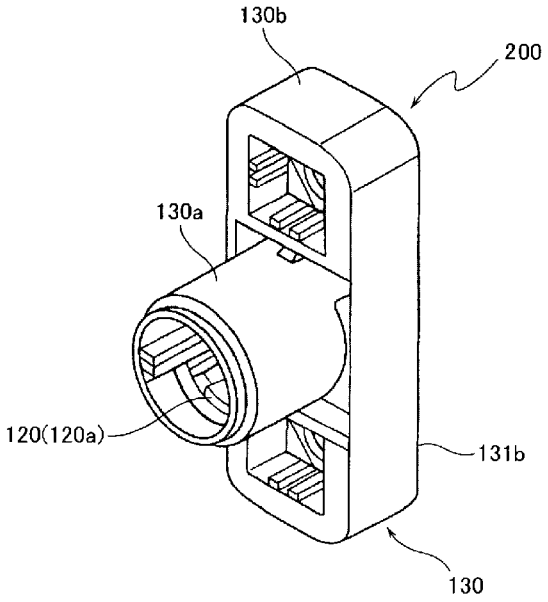
FIGS. 12A and 12B are perspective views showing the whole of the terminal members (terminal block) of the mating connection device according to the second embodiment of the present invention.
Figure 12B:
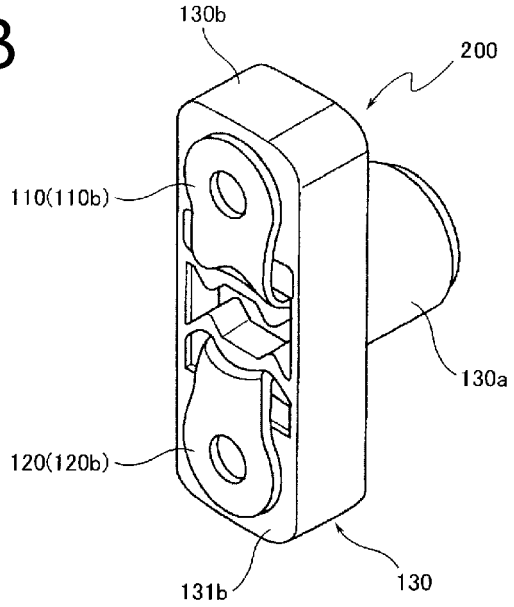

FIG. 11 is a perspective view showing the terminal block 200 according to the second embodiment with the components thereof disassembled. FIGS. 12A and 12B are perspective views showing the whole of the terminal block 200 according to the second embodiment; FIG. 12A is a perspective view showing a state in which the components shown in FIG. 11 are assembled, viewed from the terminal side, and FIG. 12B is a perspective view showing the state in which the components shown in FIG. 11 are assembled, viewed from the side opposite to that shown in FIG. 12A.

A first spring section 520*a* makes contact with the internal terminal extension section 52 and the terminal block internal terminal 110 to establish electrical connection therebetween, and is configured as a component (separate member) separated from the internal terminal extension section 52 and the terminal block internal terminal 110. Furthermore, a second spring section 620*a* makes contact with the external terminal extension section 62 and the terminal block external terminal 120 to establish electrical connection therebetween, and is configured as a component (separate member) separated from the external terminal extension section 62 and the terminal block external terminal 120.

The first spring section 520*a* is formed into a nearly semi-cylindrical shape along the curves of the internal terminal extension section 52 and the internal terminal section 110*a* of the terminal block internal terminal 110, each having a nearly semi-cylindrical shape. In addition, the second spring section 620*a* is formed into a nearly semi-cylindrical shape along the curves of the external terminal extension section 62 and the external terminal section 120*a* of the terminal block external terminal 120, each having a nearly semi-cylindrical shape. The first and second spring sections 520*a* and 620*a* generate a predetermined elastic force (pushing force) when bent and deformed elastically, thereby maintaining the contact state between the internal terminal extension section 52 and the internal terminal section 110*a* and the contact state between the external terminal extension section 62 and the external terminal section 120*a* by using the pushing force so that electrical connection can be established therebetween. The configuration of each of the first and second spring sections 520*a* and 620*a* is not limited particularly, provided that such an electrical connection state as described above can be established; however, in the second embodiment, a configuration is taken as an example in which a plurality of slits are formed in the axial direction of the cylindrical shape thereof so as to provide spring pieces 521*a* and 621*a* between the slits, and the spring pieces 521*a* and 621*a* are formed into a curved concave shape in a diameter shrinking direction so that the spring pieces can be bent and deformed elastically. Moreover, spring opening sections 522*a* and 622*a* for locking the terminal block internal terminal locking section 130*c* or the terminal block external terminal locking section 130*d* of the terminal block housing 130 are formed in the first and second spring sections 520*a* and 620*a* (see FIG. 10).

In the terminal block housing 130 of the terminal block 200, the internal terminal section 110*a* of the terminal block internal terminal 110 and the external terminal section 120*a* of the terminal block external terminal 120 are inserted into the terminal holding section 130*a* of the terminal block housing 130 from one side (the left side in FIG. 10) in the connection direction. Then, the first and second spring sections 520*a* and 620*a* are inserted into the insides of the internal terminal section 110*a* and the external terminal section 120*a* from the one side in the connection direction. Consequently, the terminal block internal terminal locking section 130*c* is engaged with the edge section of the opening section 521*a*, whereby the first spring section 520*a* is positioned and fixed with respect to the terminal block housing 130. Furthermore, the internal terminal section 110*a* is held between the first spring section 520*a* and the terminal holding section 130*a*, whereby the terminal block internal terminal 110 is positioned and fixed with respect to the terminal block housing 130. Similarly, the terminal block external terminal locking section 130*d* is engaged with the edge section of the opening section 621*a*, whereby the second spring section 620*a* is positioned and fixed with respect to the terminal block housing 130. Moreover, the external terminal section 120*a* is held between the second spring section 620*a* and the terminal holding section 130*a*, whereby the terminal block external terminal 120 is positioned and fixed with respect to the terminal block housing 130. As a result, the terminal block housing 130 is set to a state in which the terminal block internal terminal 110 and the terminal block external terminal 120 are disposed coaxially while being separated from each other and held by the terminal holding section 130*a*.

Then, the terminal holding section 130*a* of the terminal block housing 130 is fitted on the terminal holding section 162 of the terminal housing 16. Hence, the first spring section 520*a* is fitted on the outer circumference side of the internal terminal extension section 52 against the elastic force (pushing force) thereof, and the internal terminal section 110*a* is made contact with the internal terminal extension section 52 by the elastic force. In other words, the internal terminal section 110*a* is connected to the internal terminal extension section 52 via the first spring section 520*a*, and electrical connection can be established between the terminal block internal terminal 110 and the internal conductor terminal 50. Similarly, the second spring section 620*a* is fitted on the outer circumference side of the external terminal extension section 62 against the elastic force (pushing force) thereof, and the external terminal section 120*a* is made contact with the external terminal extension section 62 by the elastic force. In other words, the external terminal section 120*a* is connected to the external terminal extension section 62 via the second spring section 620*a*, and electrical connection can be established between the terminal block external terminal 120 and the external conductor terminal 60. In this state, the terminal holding section 130*a* is positioned while the tip end section thereof (the right end section in FIG. 10) is made contact with the tip end section (the left end section in FIG. 10) of the terminal housing 16. In this case, the tip end section of the terminal holding section 130*a* and the tip end section of the terminal housing 16 are formed so as to protrude alternately to each other and to mesh with each other.

Consequently, the terminal block 200 in which the terminal block internal terminal 110, the terminal block external terminal 120, the first spring section 520*a* and the second spring section 620*a* are assembled and integrated with the terminal block housing 130 is connected to the electric wire 1. Furthermore, the internal terminal contact section 110*b* of the terminal block internal terminal 110 connected to the internal conductor terminal 50 and the external terminal contact section 120*b* of the terminal block external terminal 120 connected to the external conductor terminal 60 are connected to the electric wire, bus bar or the like of the mating connection device using nuts 23, whereby the electric wire 1 is in a state in which the electric wire 1 can be electrically connected to the mating connection device at the terminal block 200.

With the connection structure according to the second embodiment described above, as in the case of the first embodiment described above, the size of the terminal connection portion of the electric wire 1 can be made compact, and the workability of the terminal connection in the electric wire 1 can be improved. In addition, the size of the terminal connection portion of the mating connection device can also be made compact, whereby the size of the terminal connection portion of the electric wire 1 can be made more compact.

However, the present invention is not limited to the above-mentioned embodiments, but can be modified or improved as necessary. In addition, the materials, shapes, dimensions, quantities, arrangement positions, etc. of the respective components in the above-mentioned embodiments may be arbitrary and not limited, provided that the present invention can be achieved.

The characteristics of the above-mentioned embodiments of the terminal connection structure for the electric wire according to the present invention will be briefly summarized and listed in the following items [1] to [5].

[1] A terminal connection structure for an electric wire 1, in which terminals are respectively connected to an internal conductor 2 and an external conductor 3 in the electric wire 1, the electric wire 1 including the internal conductor 2 covered with a first insulating cover (internal insulator) 21 and the external conductor 3 covered with a second insulating cover (external insulator) 31 and provided coaxially with the internal conductor 2 so as to surround the outer circumference of the first insulating cover (internal insulator) 21, the terminal connection structure including:

a first terminal (internal conductor terminal) 5 including a first connection section (internal terminal connection section) 51 which is connected to a part where the first insulating cover (internal insulator) 21 has been peeled so that the internal conductor 2 is exposed and a first extension section (internal terminal extension section) 52 which is extended from the first connection section (internal terminal connection section) 51 in a nearly semi-cylindrical shape and is connected to a first terminal member (terminal block internal terminal) 110 of a mating connection device to be connected to the electric wire 1, and a second terminal (external conductor terminal) 6 including a second connection section (external terminal connection section) 61 which is connected to a part where the second insulating cover (external insulator) 31 has been peeled so that the external conductor 3 is exposed and a second extension section (external terminal extension section) 62 which is extended from the second connection section (external terminal connection section) 61 in a nearly semi-cylindrical shape and is connected to a second terminal member (terminal block external terminal) 120 of the mating connection device to be connected to the electric wire 1, wherein the first extension section (internal terminal extension section) 52 of the first terminal (internal conductor terminal) 5 and the second extension section (external terminal extension section) 62 of the second terminal (external conductor terminal) 6 are disposed coaxially so as to be opposed to each other and to form a nearly cylindrical shape.

[2] The terminal connection structure for an electric wire 1 configured as described in the above-mentioned item [1], being further equipped with:

a first spring section 52*a* that has a nearly semi-cylindrical shape and contacts with the first extension section (internal terminal extension section) 52 and the first terminal member (terminal block internal terminal) 110 so that the first extension section (internal terminal extension section) 52 is electrically connected to the first terminal member (terminal block internal terminal) 110; and a second spring section 62*a* that has a nearly semi-cylindrical shape and contacts with the second extension section (external terminal extension section) 62 and the second terminal member (terminal block external terminal) 120 so that the second extension section (external terminal extension section) 62 is electrically connected to the second terminal member (terminal block external terminal) 120, wherein the first spring section 52*a* and the second spring section 62*a* are disposed coaxially so as to be opposed to each other and to form a nearly cylindrical shape.

[3] The terminal connection structure for an electric wire 1 configured as described in the above-mentioned item [1] or [2], further including:

an insulation section (inner holder) 7 disposed between the first terminal (internal conductor terminal) 5 and the second terminal (external conductor terminal) 6; and a housing member (terminal housing) 8 that surrounds an outer circumference of the first terminal (internal conductor terminal) 5 and an outer circumference of the second terminal (external conductor terminal) 6, and the first terminal (internal conductor terminal) 5 and the second terminal (external conductor terminal) 6 being received coaxially so as to be separated from each other.

[4] The terminal connection structure for an electric wire 1 configured as described in any one of the above-mentioned items [1] to [3], wherein the first terminal (internal conductor terminal) 50 and the second terminal (external conductor terminal) 60 are disposed coaxially in a bent direction bent from an extension direction of the electric wire 1.

[5] The terminal connection structure for the electric wire 1 configured as described in the above-mentioned item [4], further including:

a sealing member (packing) 15 that seals the first terminal (internal conductor terminal) 50 and the second terminal (external conductor terminal) 60 from the outside, wherein the sealing member (packing) 15 includes a bottom section 15*a* and a lid section 15*b* which are separated in the bent direction, and the bottom section 15*a* and the lid section 15*b* are assembled and integrated.

With the terminal connection structure for the electric wire according to the present invention, the size of the terminal connection portion of the electric wire (coaxial electric wire) can be made compact.

What is claimed is:

1. A terminal connection structure for an electric wire, in which terminals are connected to an internal conductor and an external conductor respectively in the electric wire, the electric wire comprising the internal conductor which is covered with a first insulating cover and the external conductor which is provided coaxially with the internal conductor to surround an outer circumference of the first insulating cover and covered with a second insulating cover, the terminal connection structure comprising:

a first terminal comprising a first connection section which is connected to a part where the first insulating cover has been peeled so that the internal conductor is exposed and a first extension section which is extended from the first connection section in a nearly semi-cylindrical shape and is connected to a first terminal member of a mating connection device to be connected to the electric wire; and a second terminal comprising a second connection section which is connected to a part where the second insulating cover has been peeled so that the external conductor is exposed and a second extension section which is extended from the second connection section in a nearly semi-cylindrical shape and is connected to a second terminal member of the mating connection device to be connected to the electric wire, wherein the first extension section of the first terminal and the second extension section of the second terminal are disposed coaxially so as to be opposed to each other and to form a nearly cylindrical shape.

2. The terminal connection structure for an electric wire according to claim 1, further comprising:

a first spring section that has a nearly semi-cylindrical shape and contacts with the first extension section and the first terminal member so that the first extension section is electrically connected to the first terminal member; and a second spring section that has a nearly semi-cylindrical shape contacts with the second extension section and the second terminal member so that the second extension section is electrically connected to the second terminal member, wherein the first spring section and the second spring section are disposed coaxially so as to be opposed to each other and to form a nearly cylindrical shape.

3. The terminal connection structure for an electric wire according to claim 1, further comprising:

an insulation section disposed between the first terminal and the second terminal; and a housing member that surrounds an outer circumference of the first terminal and an outer circumference of the second terminal, and the first terminal and the second terminal being received coaxially so as to be separated from each other.

4. The terminal connection structure for an electric wire according to claim 1, wherein the first terminal and the second terminal are disposed coaxially in a bent direction bent from an extension direction of the electric wire.

5. The terminal connection structure for an electric wire according to claim 4, further comprising:

a sealing member that seals the first terminal and the second terminal from the outside, wherein the sealing member comprises a bottom section and a lid section which are configured to be separated in the bent direction, and the bottom section and the lid section are assembled and integrated.

* * * * *